United States Patent [19]

Monahan

[11] Patent Number: 4,747,281

[45] Date of Patent: May 31, 1988

[54] RANDOMLY AND INTEGRALLY RE-KEYABLE LOCK APPARATUS AND METHOD

[76] Inventor: Brian J. Monahan, 28895 Cragmont Dr., Evergreen, Colo. 80439

[21] Appl. No.: 30,620

[22] Filed: Mar. 27, 1987

Related U.S. Application Data

[63] Continuation-in-part of Ser. No. 881,227, Jul. 2, 1986.

[51] Int. Cl.[4] ..... E05B 25/00

[52] U.S. Cl. ..... 70/383; 70/384; 70/385

[58] Field of Search ..... 70/383, 384, 382, 385, 70/395, 398, 400

[56] References Cited

U.S. PATENT DOCUMENTS

| | | | |
|---|---|---|---|
| 1,896,319 | 2/1933 | Littell | 70/382 |
| 3,059,462 | 10/1962 | Check | 70/384 |
| 3,431,757 | 3/1969 | Hori | 70/383 |
| 4,412,437 | 11/1983 | Smith | 70/385 |

*Primary Examiner*—Robert L. Wolfe

*Attorney, Agent, or Firm*—Chester E. Martine, Jr.

[57] ABSTRACT

A lock apparatus includes a key-in-knob lock, padlock or other type of 90° lock provided with a cylindrical plug having a keyway for receiving a master key that has bittings for positioning a master pin in the top portion of a first pinway with the bottom of the master pin aligned with the shear interface to unlock the lock. The plug has a guideway at the surface thereof and angularly displaced from the keyway less than 180° for receiving the master pin during re-keying. A blocking rod is received in the guideway for normal, non-re-keying use of the lock. After removal of the rod from the guideway, a transfer tool is slidable into the guideway. The tool has a cut for receiving the master pin from the first pinway. The tool slides relative to the guideway and moves the master pin in the guideway to directly reposition the master pin adjacent a randomly selected second pinway. A handle rotates the tool relative to the guideway to cam the master pin out of the cut into the second pinway to change the height of the pin stack in the second pinway to randomly and integrally re-key the lock without removal of the master pin from the lock or disassembly of the lock.

20 Claims, 8 Drawing Sheets

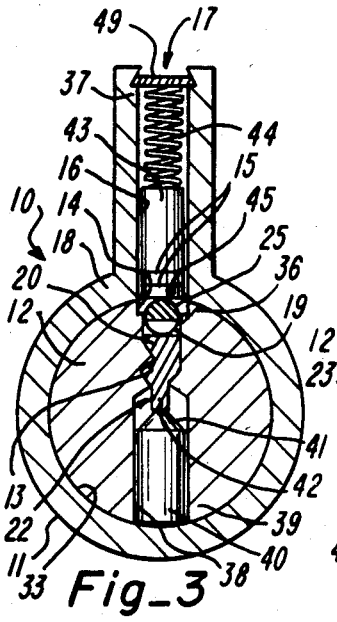
Fig_3
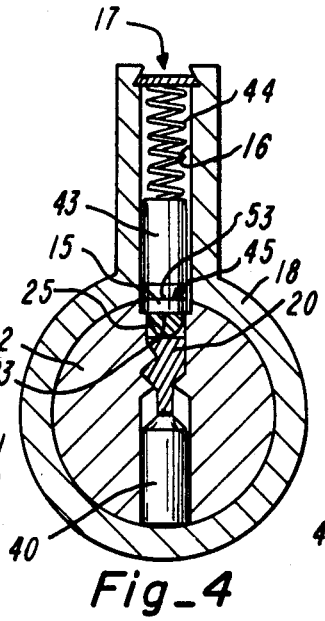
Fig_4
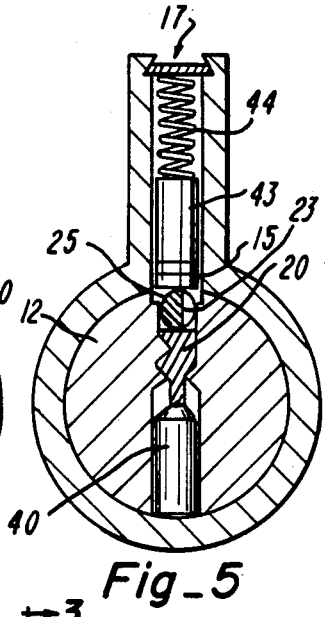
Fig_5
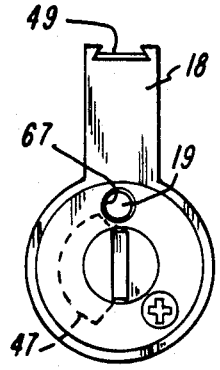
Fig_6
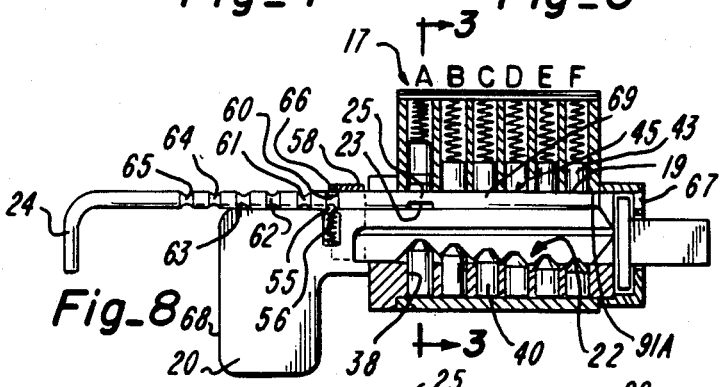
Fig_8
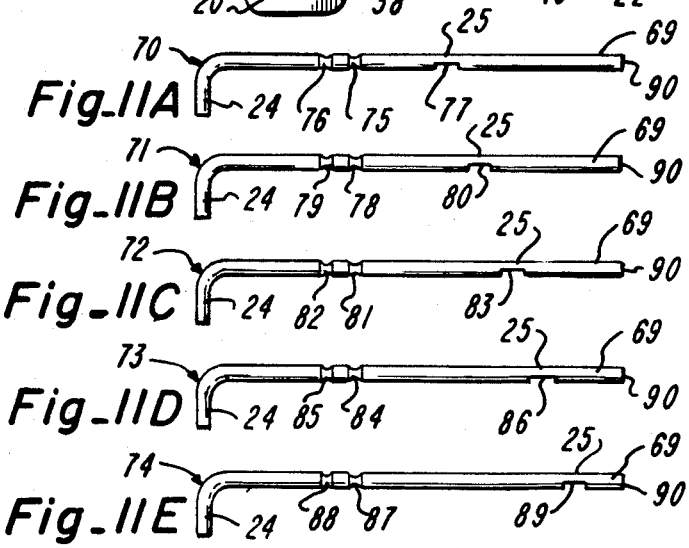
Fig_11A
Fig_11B
Fig_11C
Fig_11D
Fig_11E

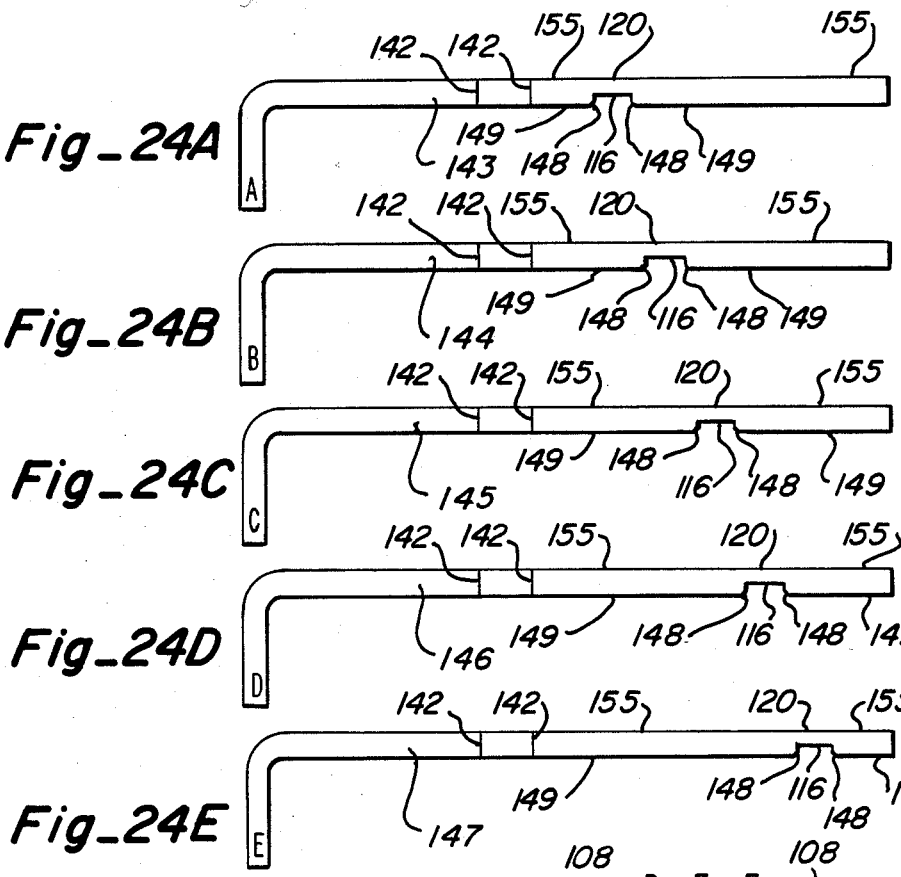
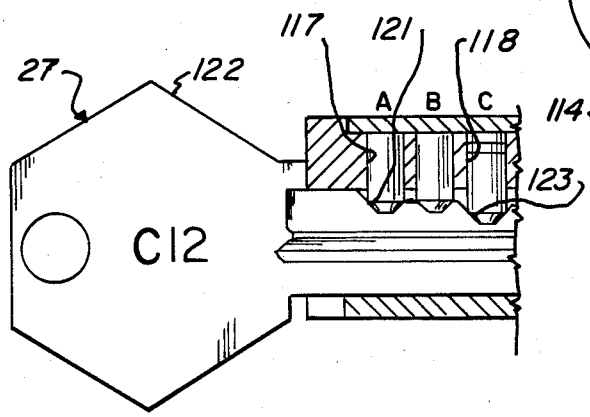
Fig_25A
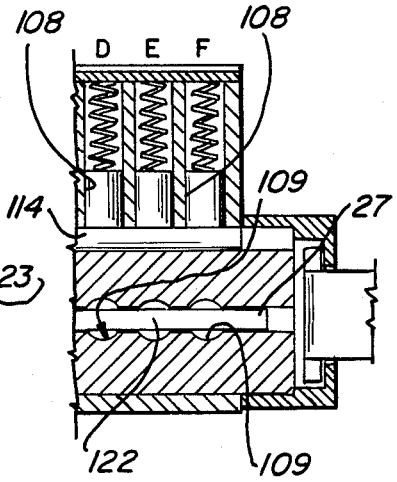
Fig_25B

RANDOMLY AND INTEGRALLY RE-KEYABLE LOCK APPARATUS AND METHOD

CROSS REFERENCE TO RELATED APPLICATION

This application is a continuation-in-part of co-pending patent application Ser. No. 881,227, filed July 8, 1986 for RANDOMLY AND INTEGRALLY RE-KEYABLE LOCK APPARATUS AND METHOD in the name of Brian J. Monahan.

BACKGROUND OF THE INVENTION

1. Field of the Invention

The present invention relates to locks and more particularly to an apparatus for and method of re-keying a key-in-knob or padlock-type pin tumbler cylinder lock having tumbler pins, driver pins and at least one master pin without disassembly of the lock apparatus or removal or replacement of any master pins therefrom or therein.

2. Description of the Prior Art

The pin tumbler lock principle is widely used in builders hardware locks, padlocks and cabinet locks. A pin tumbler lock housing has a cylindrical main bore extending longitudinally therethrough to rotatably accommodate a cylindrical plug having a flange at its front end to limit its rearward movement relative to the housing. The plug has a keyway extending longitudinally therethrough at the bottom of the plug. A plurality of parallel and equally spaced cylindrical top pinways extend perpendicular to the main bore from the top of the housing into the main bore to align with correspondingly spaced cylindrical bottom pinways extending from the top of the plug to part way into the keyway. Retainers of various types secured to the rear end of the plug provide a minimum of end play between the plug and the housing when the lock is assembled. Each pinway extending from the top of the housing to part way into the keyway has within it a tumbler pin having a truncated conical bottom end that engages a truncated cut or bitting on the top edge of a key inserted in the keyway. The bitting positions the tumbler pin vertically in the pinway. Above each tumbler pin is a driver pin of sufficient height to block a shear interface between the plug and the housing when the tumbler and driver pins are bottomed in their pinway. Above each driver pin is a compression spring that biases the driver pin and the tumbler pin in a downward direction. The height of a tumbler pin is such that the interface between the tumbler pin and the driver pin is located at the shear interface by a properly selected bitting on a key inserted in the keyway. When the key bittings locate all such driver pin and tumbler pin interfaces at the shear interface, the plug is free to rotate and retract a bolt or latch by means of the surfaces of the retainer, or an extension thereof, acting on the bolt or latch.

Tumbler pin heights and bitting depths of the key are multiples of an increment established by the manufacturer. There are usually ten tumbler pin heights and ten corresponding bitting depths numbered zero through nine, zero designating the shortest tumbler and the shallowest bitting depth and nine designating the tallest tumbler and the deepest bitting depth. The increment is large enough to ensure that a key having one or more bitting depths shallower or deeper than corresponding tumblers will not permit the plug to rotate because of the normal clearance between the plug and the housing.

A key that is intended for use with an individual lock or a group of locks keyed alike is referred to as a change key. A key that will operate a group of locks, each of which is operated by its own unique change key, is referred to as a master key. Pin tumbler locks are masterkeyed by using short pins called master pins between the tumbler pin and the driver pin in a given pinway. A tumbler pin, a driver pin and any master pins between them can be referred to as a tumbler stack. The interface between a master pin and a driver pin usually determines the change key bitting. The interface between the tumbler pin and the master pin usually determines the master key bitting. A plurality of locks can thus be set up to each operate only with its own unique change key, yet all of the locks can be operated with the same master key.

For ease of reference, the locations of the pinways, and thus the locations of the bittings for operating the tumbler stack in the respective pinways, are referred to as stations designated by the letters A, B, C, etc., with station A relating to the pinway that is closest to the front of the lock.

The necessity to re-key locks is an ongoing problem, particularly with a turnover of employees and tenants. Some concerns, such as banks, consider re-keying on a periodic basis to be a matter of good policy. Normally, re-keying for a different unique change key of a lock requires disassembly of the lock and removal and replacement of tumbler pins with tumbler pins of different heights if the lock is not masterkeyed. If masterkeyed, removal and replacement with different-height master pins has been required. Ideally, the delay in waiting for and the expense of a locksmith are to be avoided.

Attempts have been made to remove a temporary pin from a lock so that the lock cannot be operated by a temporary key. The temporary pin is provided in one of the pinways. When the removable temporary pin is removed from such lock, the original temporary key is no longer usable to operate the lock because the driver pin extends across the shear interface when the temporary key is used. In such lock, a disabling key is bitted such that the driver pin-tumbler pin interfaces of the pins in the pinways that do not have removable pins are aligned with the shear interface. Also, the removable temporary pin is in the top pinway with the bottom thereof aligned with the shear interface. The disabling key is thus enabled to rotate the plug so that a cut in the bottom of the disabling key is positioned under the top pinway. The keyway is enlarged to allow the removable pin to move into the cut and, as the disabling key is removed from the lock, to allow the removable pin to be pulled completely out of the lock. Such locks could provide re-keying by requiring use of many different change keys only to the extent that many removable temporary pins are provided when the lock is originally assembled. Such requirement for many removable pins to enable use of many different change keys is inherently disadvantageous since the more master pins (e.g. the removable pins) there are in the tumbler stacks, the easier the lock is to pick.

Later attempts to, such as Smith U.S. Pat. No. 4,440,009, overcome such disadvantage used similar removable master pins and disabling keys to remove such master pins from the lock. Once the removable master pin was removed from the lock, a new removable master pin was loaded into a cut formed in a second re-keying key provided with a leaf spring biased by the removable master pin in the cut. With the new removable master pin held in the cut against the bias of the leaf spring, the second re-keying key was inserted into the keyway. The second key was bitted to operate the lock to allow rotation of the key and plug and positioning of the spring biased new master pin opposite to a desired top pinway. The leaf spring urged the new master pin into the top pinway against the action of the compression spring. Although such second key enabled the replacement of a new master pin into the lock, problems arose in attempting to hold the new master pin in the slot against the action of the leaf spring while inserting the second key and the new master pin into the keyway. Moreover, since the bias of the leaf spring must be greater than that of the compression spring to allow the new master pin to be pushed into the top pinway, the second key cannot be used to remove the removable master pin from the original pinway. Thus, two keys are required to successively remove a master pin from the lock and add a new master pin to the lock. Further, the requirement that the leaf spring act against the bias of the compression spring to push the new master pin into the pinway doesn's provide any positive assurance that the new pin has actually entered the pinway.

Improvements in such locks have been directed to assuring that the removable pins fit loosely in the cut in the first re-keying key and to preventing the driver pins from entering the cut by making the diameter of the cut and the removable pins less than that of the driver pin. See, for example, Smith U.S. Pat. No. 4,412,437.

Locks have generally been keyed for operation using many keys, including, for example, a key for use only during construction. The removal of the master pin prevents use of the construction key with the lock, while all of the rest of the original keys can operate the lock. However, the re-keying keys and the structure of the lock do not render the lock usable with only one of the many keys instead of the construction key that is locked-out.

Independent of these efforts to provide a re-keyable lock, in one prior lock a slot was provided in the plug for receiving a slide having eight holes for use with four pinways. When the lock was assembled, the extra or auxiliary holes were either empty, filled with master pins having a height that was equal to the full thickness of the slide or filled with master pins that were shorter than the full thickness of the slide. A set screw was used to move the slide in the slot into one of two positions to align two different sets of the holes with the pinways. Because of the different arrangement of holes and master pins in each of the two positions of the slide, a different change key was required to operate the lock for each position of the slide. However, without increasing the length of the lock, or disassembling the lock, the lock could be re-keyed for only two change keys. Further, because of the variable thickness master pins and empty holes, once the slide was moved to the rear of the lock, the lock had to be disassembled to move the slide forward to re-key the lock.

SUMMARY OF THE INVENTION

In contrast to the prior art that requires two re-keying keys to remove and then replace master pins, or that adds a slide to the plug for rearranging holes or different depth master pins, preferred embodiments of the method and apparatus of the present invention minimize the number of master pins used while increasing the number of different change keys to achieve the following objectives.

Initially, the present invention utilizes a change principle wherein master pins can be transferred directly from one pinway to any other pinway in the lock to provide different, exclusive change key bitting combinations or settings.

Secondly, only one exclusive change key bitting at a time can operate the lock and there are a minimum of master pins for an increased number of change keys and maximum pick resistance, yet there is always a master key.

Thirdly, it is possible to adapt a standard, existing lock to use the principles of the present invention, which standard lock has a plug that is rotatable about 180° to move the keyway from its normal locked position to an opposite unlocked position. For ease of description, this type of lock is referred to herein as a "180° lock". The only changes that need be made to the 180° lock are that the bottom of the keyway in the plug is milled wider opposite to and only between the pinways to accommodate the full diameter of the master pins and the full length of the keyway is enlarged end to end to receive a tool for transferring the master pins among the pinways.

Fourthly, it is possible to adapt a standard, existing lock to use the principles of the present invention, where the standard lock is a key-in-knob or padlock-type pin tumbler lock. This type of lock has a plug that is rotatable substantially less than 180° to move the keyway from its normal locked position to an unlocked position. For ease of description, such types of locks are referred to herein as a "90° lock", it being understood that either the key-in-knob, the padlock-type lock or any other lock is included in the term "90° lock" as used herein if the unlocked and locked positions of the plug are substantially less than 180° apart. For example, 90° locks may have the unlocked and locked positions of the plug from 45° to 135° apart. For such 90° locks, the only changes that need be made are that (1) a slot is milled in the outer surface of the plug so as to be opposite the pinways when the plug is in its unlocked position, where the slot starts at the front pinway and is dimensioned to receive the full width and depth of a master pin, (2) the full length of the plug is provided with a groove that intersects the slot for receiving a blocking rod that keeps the driver pins and the master pins out of the slot in normal use of the lock, and (3) an end of the groove is tapped for mating with a threaded end of the blocking rod to removably secure the blocking rod in the groove.

In one embodiment for such 180° locks, the method of the present invention provides a transfer key and a transfer tool that is slidable relative to the bottom edge of the transfer key. With the transfer key and the transfer tool inserted in the keyway, the transfer key guides the transfer tool for longitudinal movement. When the plug is rotated 180° from the locking position and the transfer tool is rotated, a cut provided in the transfer tool captures a master pin from a first pinway. The transfer tool is slid along the transfer key to directly align the cut and the master pin with a selected new pinway. The transfer tool is again rotated so that the master pin rides up onto a cam provided on the tool adjacent to the cut. If the cut is inadvertently aligned with a driver pin instead of a master pin, and the transfer tool is rotated, the driver pin will also be cammed or positively inserted back into the top pinway.

For the 90° locks, the method of the present invention uses a master key for unlocking the lock and rotating the plug substantially less than 180°, such as from 45° to 135°, to an unlocked position at which the latch is released. A blocking rod is threaded into a tapped hole that extends into a groove that extends in the plug under the driver pins in such unlocked position. Before the master key unlocks the lock and rotates the plug to the unlocked position, the blocking rod is removed from the groove and a transfer tool is inserted into the groove. A slot formed in the outer surface of the plug intersects the groove and is dimensioned to receive the master pin and permit it to move directly under any of the tumbler pins. In one embodiment the slot is formed only opposite and between the pinways. With the transfer tool inserted in the groove, the transfer tool is rotated so that a cut provided therein captures the master pin from a first pinway. The transfer tool is slid along the groove to slide the master pin in the slot and directly align the cut and the master pin with a randomly selected new pinway. The transfer tool is again rotated so that the master pin rides up onto a cam provided on the tool adjacent to the cut. The cam holds the master pin in the new, randomly selected pinway as the master key is used to rotate the plug from the unlocked position. The transfer tool is then removed from the groove and the blocking rod replaced therein to facilitate use of the lock with a new change key for which the 90° lock is now re-keyed.

In another embodiment, the groove for the blocking rod intersects a larger groove that starts opposite the A pinway and extends to the end of the plug.

With these and other objects in mind, a standard 180° lock apparatus in accordance with the present invention is provided with a cylindrical plug having a keyway that is widened to form a slot adjacent the surface of the plug for receiving a master pin from a top pinway of the lock. In one embodiment the slot has shoulders at the opposite ends thereof to prevent removal of the master pin from the lock. If the lock has been assembled, the plug is removed to facilitate forming the slot and inserting a master pin between the driver pin and the tumbler pin in a first one of the pinways.

The modified standard 180° lock apparatus includes a transfer key for facilitating re-keying of the lock. The transfer key has bittings along a first edge thereof for positioning the master pin in the top portion of the first pinway and aligning the bottom of the master pin with the shear interface. A transfer tool slidable relative to the transfer key on the side thereof opposite to the bittings is provided with a cut or slot for receiving the master pin from the first pinway. The tool slides relative to the transfer key parallel to the keyway for directly repositioning the master pin adjacent a randomly selected second pinway without removal of the master pin from the lock. The 180° lock apparatus includes a handle for rotating the tool relative to the transfer key to cam the master pin out of the cut in the tool and into the second pinway to change the height of the second pin stack in the second pinway without removal of the master pin from the lock.

With these and other objects in mind, a standard 90° lock apparatus in accordance with the present invention is provided with a cylindrical plug having a standard keyway. To modify the standard 90° lock according to the principles of the present invention, along a line that is displaced around the circumference of the plug by from about 45° to 135° from the keyway, the outer surface of the plug is modified to form a slot adjacent the surface of the plug for receiving a master pin from a top pinway of the lock. In one embodiment the slot has shoulders at the opposite ends thereof to prevent removal of the master pin from the lock. Alternatively, only one shoulder is provided and is located at the front of the slot to prevent removal of a master pin during re-keying. If the standard 90° lock has been assembled, the plug is removed to facilitate forming the slot and inserting a master pin between the driver pin and the tumbler pin in a first one of the pinways. The plug is further modified by drilling a hole into the front end of the plug and through the front shoulder to intersect the slot and form a groove for receiving a transfer tool. The front end of the hole is tapped to removably secure a blocking rod that extends through the tapped hole and along the groove.

The modified 90° lock apparatus includes a master key that is also used for facilitating re-keying. The master key has bittings along a first edge thereof for positioning the master pin in the top portion of the first pinway and aligning the bottom of the master pin with the shear interface. After removal of the blocking rod from the groove, but before unlocking the lock, a transfer tool is inserted into the groove. The transfer tool is provided with a cut or slot for receiving the master pin from the first pinway. The tool slides relative to the groove parallel to the slot for directly repositioning the master pin adjacent a randomly selected second pinway without removal of the master pin from the lock. The apparatus includes a handle for rotating the transfer tool in the groove to cam the master pin out of the cut in the tool and into the second pinway to change the height of the second pin stack in the second pinway without removal of the master pin from the lock.

In a preferred embodiment of the present invention for use with such modified standard 180° locks, the tool is a cylindrical rod. The cut is in one side thereof and extends perpendicular to the longitudinal axis of the rod. The rod has a cam surface adjacent the cut. When the master pin is received in the cut, the handle is effective to rotate the rod so that the master pin rides onto the cam surface and moves into the second pinway so that the bottom of the master pin is aligned with the shear interface. The transfer key and the transfer tool are provided with cooperating releasable detents for sequentially aligning the cut with the first and second pinways to position the slot for successively receiving the master pin from the first pinway and then moving the master pin into the second pinway.

In a preferred embodiment of the present invention for use with such 90° locks, the transfer tool is a cylindrical rod. The cut is in one side thereof and extends perpendicular to the longitudinal axis of the rod. For use with multiple master pins, where different depth master pins are used, the cut is as deep as the highest-depth master pin and the edges of the cut are chamfered to the depth of the least-depth master pin. The rod has a cam surface adjacent the cut. When the master pin is received in the cut, and the cut is up and positioned under a first pinway having a master pin therein, the master pin will enter the cut. If the master pin is a least-depth master pin, as the tool is initially moved in the groove toward a second, randomly selected next pinway, the driver pin will be cammed up by the chamfer to allow the tool to move further. When the master pin is at such second pinway, the handle is effective to rotate the rod so that the master pin rides onto the cam surface and moves into such second pinway so that the bottom of the master pin is aligned with the shear interface. The rod is provided with index lines on the outer surface thereof. The lines cooperate with the front of the plug for aligning the cut with the first and second pinways to position the slot for successively receiving the master pin from the first pinway and then moving the master pin into alignment with the second pinway.

A method in accordance with the present invention may render a standard 180° pin tumbler lock usable with a plurality of different change keys without disassembling the lock or removing any parts from or replacing any parts in the lock each time the lock is reset for a different change key. The method may be performed with such standard 180° pin tumbler lock or a lock of the present invention. The method for the standard 180° lock includes the steps of removing the plug from the bore and enlarging the keyway along the intersection thereof with the bottom of the plug and only for a distance corresponding to the distance from the first pinway to the second pinway. The depth and width of the enlarged keyway are sufficient to receive a master pin that is inserted into a first pinway. Also, if the bottom of the keyway has ribs, the full length of the keyway is also milled to provide room for a master pin transfer tool. The plug is replaced in the bore to render the lock usable with a plurality of different change keys.

For a standard 90° lock, instead of enlarging the keyway, such rendering method includes forming the slot and the groove in the plug and inserting the blocking rod into the groove for normal use of the lock.

To re-key the standard 180° lock, a transfer key is provided and has bittings along one edge for unlocking the lock. The master pin transfer tool is slidable along an opposite edge of the transfer key. The lock is unlocked by inserting the transfer key and the transfer tool into the keyway and rotating the plug with the transfer key and the transfer tool to position the transfer tool adjacent the top pinways. The transfer tool is moved along the transfer key to position the cut for receiving the master pin from the first pinway. The transfer tool is rotated to capture or receive the master pin. The transfer tool then slides the master pin within the enlarged keyway directly into alignment with the second pinway without removal from the lock. The tool is rotated relative to the transfer key to cause the master pin to ride onto the cam surface formed on the tool adjacent the cut to positively insert the master pin into the second pinway. The master pin changes the height of the pin stacks in the first and second pinways so that the second change key can, and should, have a deeper bitting depth at the second station and must have a shallower bitting depth at the first station.

For re-keying the 90° locks, the re-keying method includes the removal of the blocking rod from the groove and the replacement thereof with the transfer tool before unlocking the lock. After unlocking, the transfer tool now slides along the groove and the slot to relocate the master pin from the first pinway to the second pinway.

The method of re-keying a modified standard 180° lock also includes steps by which the setting of the lock may be reversed without disassembling the lock. This includes unlocking the lock by again inserting the transfer key and the transfer tool into the keyway and rotating the plug, the transfer key and the transfer tool to position the transfer tool opposite the top pinways. The moving steps are again performed with the slot initially positioned to receive the master pin from the second pinway and to transfer the master pin to and insert it into the first pinway. The rotating step is performed again to restore the stack heights to their original amounts without disassembling the lock. Alternatively, if the lock is provided with pinways intermediate the first and second pinways, the unlocking, moving and rotating steps can be performed to insert the master pin directly into a selected one of the intermediate pinways without removing the master pin from the lock or disassembling the lock.

The 90° locks can also be reverse re-keyed in a similar manner using the transfer tool after removal of the blocking member, insertion of the transfer tool and unlocking of the lock.

BRIEF DESCRIPTION OF THE DRAWINGS

As will appear from the description to follow, the present invention can be constructed in other forms and configurations. The foregoing and other features and advantages of the invention will become apparent upon making reference to the drawings wherein:

FIG. 3 is a partial vertical cross section through the center of the forwardmost pinway with a tumbler pin, two master pins, a driver pin and a spring shown full bodied;

FIG. 4 is similar to FIG. 3 but shows the transfer tool rotated 180° and one master pin in a cut in the transfer tool;

FIG. 5 is similar to FIG. 4 but shows the transfer tool rotated 90° and the master pin cammed back up into a housing pinway;

FIG. 6 is a rear view of the lock with the plug rotated 180° from the locking position and showing a hole in the retainer for allowing the transfer tool to extend rearwardly of the retainer;

FIG. 8 is a cross sectional view similar to FIG. 7, but the first change key has been removed from the lock and the transfer key and the transfer tool, shown full bodied, have been inserted into the lock;

FIGS. 11A through 11E are right side views of a second embodiment of the present invention showing five transfer tools, the topmost of which permits transferring a master pin from the A pinway to the B pinway and back again to the A pinway, and the others of which permit transposing master pins between adjacent pairs of pinways among the rest of the pinways without any of the five transposing tools extending rearwardly of a retainer that is not provided with the hole shown in FIG. 6;

FIGS. 24A through 24E are right side views of another embodiment of the present invention for use with 90° locks, showing five transfer tools, the topmost of which permits transferring a master pin from the A pinway to the B pinway and back again to the A pinway, and the others of which permit transferring master pins between adjacent pairs of pinways among the rest of the pinways without any of the five transfer tools extending rearwardly of a retainer that is provided at the rear of the 90° lock;

FIG. 25A is a horizontal cross sectional view taken on line 25A—25A in FIG. 17 showing the front three pinways of the 90° lock, where the C12 change key has been inserted into the 90° lock for operating the 90° lock following re-keying, the re-keying having relocated the master pins to the C station;

FIG. 25B is a vertical cross sectional view similar to FIG. 18 but only showing the rear three pinways, where the plug is in the unlocked position and the blocking rod is shown holding the driver pins in the housing pinways;

DESCRIPTION OF THE PREFERRED EMBODIMENTS

Figure 1:
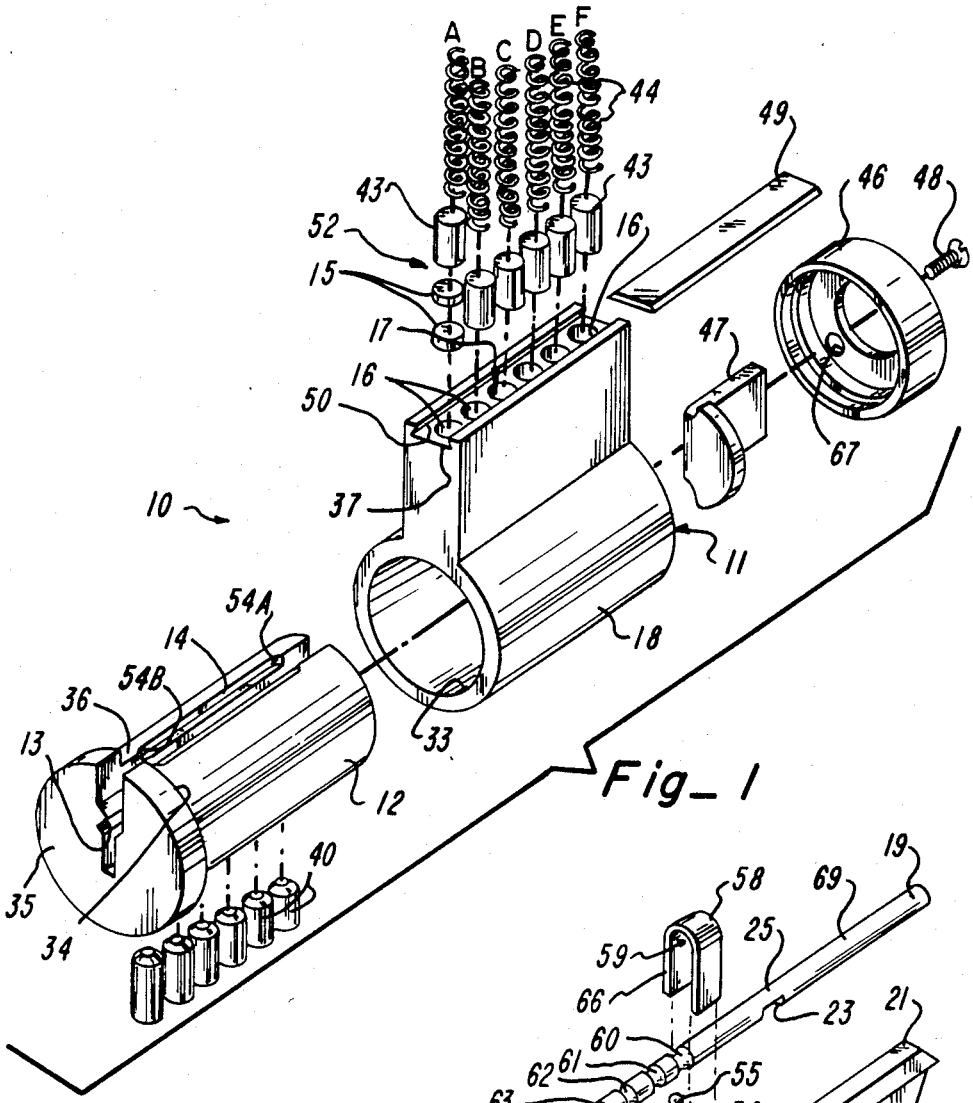
FIG. 1 is an exploded view of the standard, 180° modified lock with the plug rotated 180° from a locking position.

The first preferred embodiment of the lock apparatus of the present invention is illustrated in FIG. 1 as including a lock apparatus 10 that may be used to perform the methods of the present invention to render a pin tumbler lock 11 re-keyable and to re-key the lock 11 without disassembling the lock 11 or removing any parts from or replacing any parts in the lock 11. A cylindrical plug 12 of the lock 11 has a keyway 13. The lock 11 is referred to as a "standard" 180° type lock to distinguish from the standard 90° lock shown in FIGS. 17 through 29. The plug 12 of the standard 180° lock generally rotates at least 180° from a locked to an unlocked position. The keyway 13 is widened to form a slot 14 having a width and depth sufficient for receiving a master pin 15 from a top portion 16 of one of a series of pinways 17. The slot 14 has a limited length in the direction of the keyway 13 to prevent removal of the master pin 15 from the lock 11.

In the method of rendering the lock 11 re-keyable, if the lock 11 has been assembled, the plug 12 is removed from a housing 18 to facilitate forming the slot 14 in the plug 12, whereafter the plug is replaced in the housing 18.

A transfer tool 19 (FIG. 2) is slidably mounted on a transfer key 20 on a side 21 of the key 20 opposite to bittings 22. A cut or slot 23 formed in the transfer tool 19 receives the master pin 15 from a first one of the pinways 17 (station A, for example, FIG. 8). The transfer tool 19 is slidable relative to the transfer key 20 for repositioning the master pin 15 randomly and directly from the first of the pinways 17 to any second one of the pinways 17 (station B, for example) without removing the master pin 15 from the lock 11. The tool 19 is provided with a handle 24 for rotating the tool 19 relative to the transfer key 20 so that the master pin 15 rides out of the slot 23 onto a cam surface 25 (FIGS. 2 through 5) that lifts the master pin 15 and positively inserts it into the second one of the pinways 17.

Figure 7:
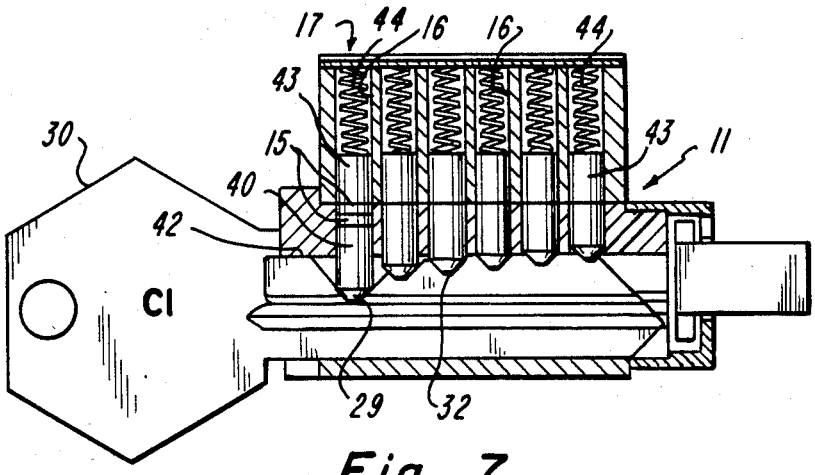
FIG. 7 is a partial vertical transverse cross sectional view through the center of the assembled lock showing the master pins in a randomly selected, initial pinway and a first change key shown having bittings for operating the lock.

With the master pin 15 transferred from the first one of the pinways 17 into the second one of the pinways 17, a bitting 26 for station A (corresponding to the first one of the pinways 17) of a second change key 27 (FIG. 9) must be shallower than the station A bitting 29 of an original or first change key 30 (FIG. 7). Also, a station C bitting 31 (for the second one of the pinways 17) of the second change key 27 can, and should, be deeper than a station C bitting 32 of the original change key 30 to operate the lock 11.

The method of re-keying the lock 11 according to the present invention includes using the transfer key 20 to unlock the lock 11. With the transfer tool 19 positioned along the transfer key 20, the transfer key 20 is rotated to position the cut 23 of the transfer tool 19 adjacent the first one of the pinways 17 (station A, FIG. 8) that contains the master pin 15. The handle 24 is rotated to move the cut 23 into position for receiving the master pin 15. The transfer tool 19 is then slid along the transfer key 20 to align the master pin 15 with the second of the pinways 17 (station C, FIG. 7). The second pinway 17 can be any one of the other pinways 17. The handle 24 is again rotated so that the master pin 15 rides up onto the cam surface 25 and is positively inserted into the second one of the pinways 17 (FIG. 5). The transfer key 20 and the transfer tool 19 are then rotated with the plug 12 to their original position, and the transfer key 20 and the transfer tool 19 are removed from the keyway 13 leaving the lock 11 ready to accept the second change key 27 that has the bittings 26 and 31 and other bittings 22 adapted to operate the lock 11.

Referring now to FIGS. 1 and 3, the housing 18 is shown in conventional construction including a cylindrical main bore 33 extending longitudinally therethrough to rotatably accommodate the cylindrical plug 12 having a flange 34 at its front end 35 to limit its rearward movement relative to the housing 18. The plug 12 has the keyway 13 extending longitudinally therethrough at the bottom 36 of the plug 12, it being understood that FIG. 1 shows the plug 12 rotated 180° to show the slot 14. A plurality of the top portions 16 of the pinways 17 are shown in cylindrical form, parallel and equally spaced extending perpendicular to the main bore 33. The top portions 16 extend from the top 37 of the housing 18 into the main bore 33. The top portions 16 are aligned with correspondingly spaced, parallel cylindrical bottom portions 38 of the pinways 17 extending from a top 39 of the plug 12 to part way into the key 13.

Each pinway 17 has within it a tumbler pin 40 having a truncated conical bottom end 41 that engages the bittings 22, which may be in the form of truncated cuts on the top edge 42 of the transfer key 20 or on the change keys 27 and 30 that may be inserted into the keyway 13. The bittings 22 position the tumbler pins 40 vertically in the pinway 17. Above each tumbler pin 40 is a driver pin 43 of sufficient height to block a shear interface 45 between the plug 12 and the housing 18 when the tumbler pin 40 and the driver pin 43 are bottomed in their pinway 17. Above each driver pin 43 is a compression spring 44 that biases the driver pin 43 and the tumbler pin 40 in a downward direction. The height of the tumbler pin 40 is such that the interface between the tumbler pin 40 and the driver pin 43 is located at the shear interface 45 by a properly selected bitting 22 on any of the keys 20, 27 or 30 inserted in the keyway 13. When the key bittings 22 locate all such driver pin-tumbler pin interfaces at the shear interface 45, the plug 12 is free to rotate and retract a bolt or latch (not shown) by means of the surfaces of a retainer 46, or an extension thereof, or a tailpiece 47, acting on the bolt or latch.

The lock 11 is assembled by inserting the plug 12 into the main bore 33 of the housing 18 and slipping the retainer 46 over the rear end of the tailpiece 47. The retainer 46 is secured to the plug 12 such as with a screw 48. With the plug 12 rotated into its original locked position (180° from that shown in FIG. 1), each of the top portions 16 and the bottom portions 38 forms one of the continuous pinways 17. A selected pinway 17, at the A station in FIG. 7, for example, is provided with one tumbler pin 40, two master pins 15, one driver pin 43 and one spring 44. The other pinways 17, for example at stations B through F, are provided with the same tumbler stack without the master pins 15 since a lock having a minimum of master pins 15 is more difficult to pick. Then, by compressing the springs 44 one at a time, a pinway cap 49 is slid into an undercut recess 50 in the housing 18. The final step is to stake the pinway cap 49 in place.

Figure 10:
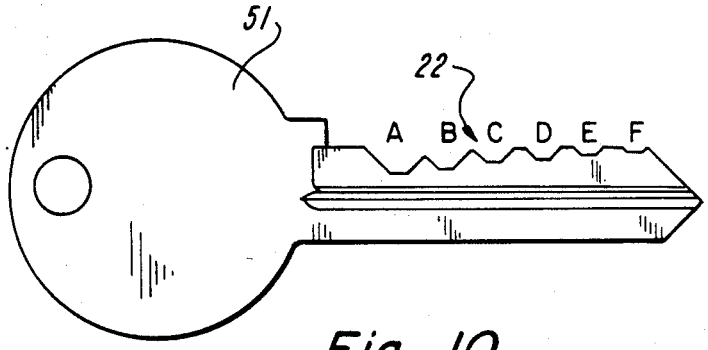
FIG. 10 is a side view of a master key shown having bittings for operating the lock when it is keyed for operation by many unique change keys.

The change keys 27 and 30 are intended for use with an individual lock, such as the lock 11, or with a group of locks that are keyed alike. A master key 51 (FIG. 10) will operate a group of locks, such as the lock 11, each of which is operated by its own unique change key, such as the change key 27.

Pin tumbler locks such as the lock 11 are master-keyed, or rendered usable with master keys 51 by using short pins such as the master pin 15 between the tumbler pin 40 and the driver pin 43 in a given pinway 17 to form a tumbler stack 52 (FIG. 1). The mater pin-driver pin interface determines the bitting requirements for the bittings 22 of the change keys 27 and 30, and the interface between the tumbler pin 40 and the master pin 15 determines the bitting requirements for the master key 51. As will become apparent, the present invention provides the ability to re-key locks, such as the lock 11, that are provided with one or more master pins 15. A plurality of the locks 11 can thus be set up to each operate with its own change key, such as the change keys 27 or 30, and all of such locks will operate with the master key 51, and will be re-keyable using the transfer key 20 and the transfer tool 19.

Still referring to FIG. 1, according to the principles of the present invention the conventional lock 11 is modified by forming the slot 14 in the keyway 13 adjacent the bottom 36 of the plug 12. As shown in FIG. 4, the slot 14 is wide enough to receive the master pin 15. The slot 14 is also shown deep enough so that the top 53 (FIG. 4 of one master pin 15 that is received in the slot 14 is in the shear interface 45 so that such master pin 15 can move in the slot 14 directly from a pinway 17 at station A, for example, to a pinway 17 at another station, such as F. The slot 14 has a shoulder 54A (FIG. 1) adjacent station F to prevent movement of a master pin 15 out of the rear of the slot 14. When the master pin 15 is adjacent the shoulder 54A it is aligned with station F. A shoulder 54B prevents movement of the master pin 15 out of the front of the slot 14. When the master pin 15 is proximate the opposite shoulder 54B it is aligned with the pinway 17 at station A.

Also, the bottom of the keyway 13 may be provided with a rib or other projection that normally extends into a groove in the bit of a change key 27, for example. If so, a ball end mill is used at the bottom of the keyway to remove the rib from the entire length of the keyway 13. The transfer tool 19 can then move in the keyway as necessary to transfer the master pin 15 from station to station.

Figure 2:
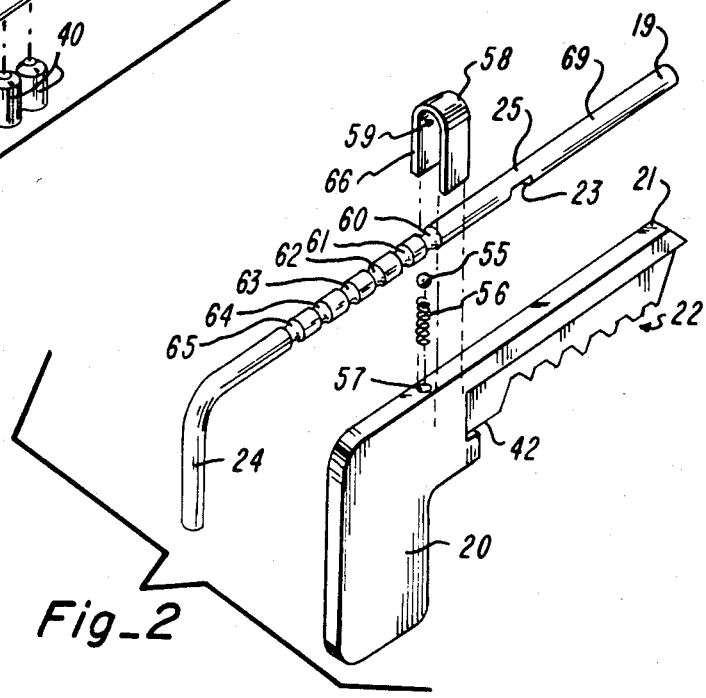
FIG. 2 is an exploded view of a transfer key and a transfer tool shown inverted corresponding to the position of the plug in FIG. 1.

FIG. 2 shows a first preferred embodiment of the transfer key 20 and the transfer tool 19 in an inverted position corresponding to the inverted position of the plug 12 shown in FIGS. 1 and 3 through 5. A ball detent 55 is installed by dropping a spring 56 into a drilled hole 57 in the bottom edge 21 of the transfer key 20. The spring 56 is depressed by pushing the ball detent 55 against it until about one-third of the ball detent 55 projects from the bottom edge 21 of the key 20. The ball detent 55 is then secured by staking the bottom edge 21 of the key partially around the ball detent 55. A saddle-shaped stamping 58 is secured to the key 20 by soldering or spot welding it in place leaving a channel or guideway 59 for insertion of the transfer tool 19.

The transfer tool 19 has six circumferential, radiused groves 60 through 65 that, in conjunction with a front edge 66 of the saddle-shaped stamping 58, act as an index or indicator to show when the cut 23 is opposite to the respective tumbler stations A through F of the lock 11. The radiused grooves 60 through 65 also cooperate with the ball detent 55 to hold the transfer tool 19 in a selected, fixed position longitudinally relative to the transfer key 20. Thus, when the ball detent 55 engages one of the grooves 60 through 65, the transfer tool 19 is releasably held so that the cut 23 is aligned with a selected one of the pinways 17 at the tumbler stations A through F. Because the grooves 60 through 65 extend completely around the circumference of the transfer tool 19, the transfer tool 19 may be rotated while held in any of the positions with the cut 23 aligned with a pinway 17.

Referring to FIG. 6, a hole 67 in the retainer 46 is shown for allowing the transfer tool 19 to extend rearwardly of the retainer 46 so that the cut 23 may be aligned with the various pinways 17 at the stations C through F.

Referring to FIG. 7, the lock 11 is shown keyed for use of the first change key 30. This key 30 is identified as "C1" for reference to Table 1 discussed below. The first change key 27 has bittings of 943210 and the tumbler pins 40 have heights of 543210. Thus, the first change key 27 positions the two master pins 15 in the A station pinway 17 below the shear interface 45. The lock 11 can be re-keyed for use of a randomly selected second change key, such as the change key 27, without assembly of the lock 11 or removal or replacement of any master pins 15 therefrom or therein. The second change key 30 is identified as "C12" also for reference to Table 1.

Referring now to FIG. 8, the lock 11 is shown assembled with the transfer tool 19 extending through the guideway 59 with the transfer tool 19 and the transfer key 20 inserted into the keyway 13 of the lock 11. When the transfer key 20 is initially inserted into the keyway 13, the handle 24 connected to the tool 19 is located outside of the lock 11 adjacent and in a position extending along an outer end 68 of the transfer key 20. After the transfer key 20, the transfer tool 19 and the plug 12 have been rotated as a unit into the position shown in FIG. 8, the cam surface 25 adjacent the cut 23 is facing upwardly and is adjacent the pinway 17, at the station A. The cam surface 25 retains the lower master pin 15 in the pinway 17 at station A. Further, a laterally extending support surface 69 extends under each of the pinways 17 at the stations B through F to retain the respective driver pin 43 and/or master pin 15 in the respective pinways 17.

The handle 24 is then used to move the tool 19 longitudinally along the transfer key 20 within the channel 59 to position the cut 23 under but rotated 180° from a selected pinway 17, shown in FIG. 8 as that at the station A. The support surface 69 supports the master pins 15. The transfer tool 19 is then rotated 180° as shown in FIG. 4, so that the bottom-most master pin 15 is biased into the cut 23 by the spring 44. The "up" position of the handle 24 (opposite to that shown in FIG. 8) indicates that the cut 23 is in position to receive the bottom-most master pin 15. If the transfer tool 19 is then rotated at least 90° in either direction from that shown in FIG. 4 to that shown in FIG. 5, the master pin 15 rides up onto the cam surface 25 out of the cut 23 and is thus forced or cammed back into the pinway 17 at the station A.

Figure 9:
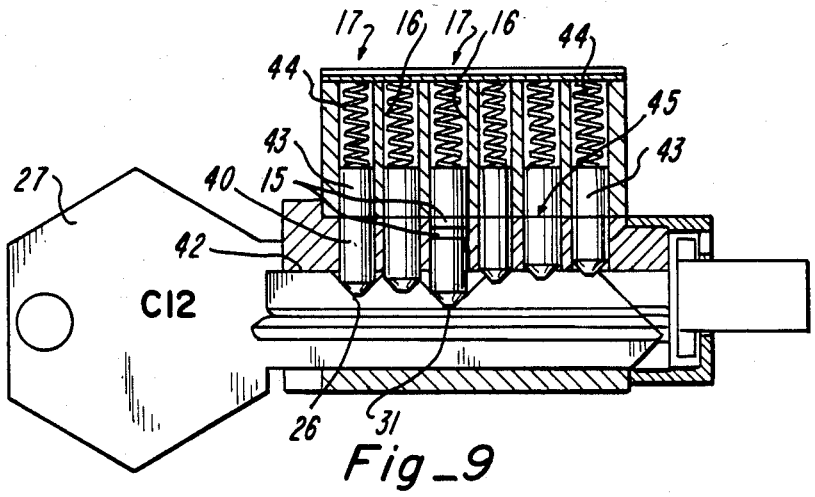
FIG. 9 is a cross sectional view similar to FIG. 8, but the transfer tool and transfer key have been removed from the lock after transfer of the master pins to a randomly selected pinway, and a second change key is shown inserted in the lock and having bittings for operating the lock.

In re-keying the lock 11, the master pin 15 is in the cut 23 as shown in FIG. 4 and the transfer tool 19 is then moved longitudinally along the transfer key 20 to place the cut 23 and the master pin 15 therein opposite to a pinway 17 at a different one of the tumbler stations B through F. In the example given of re-keying the lock 11 for use of the second change key 27, the master pin 15 is transferred to the C station pinway 17. When the cut 23 is between the pinways 17, the transfer tool 19 will rotate no more than a few degrees, which indicates with certainty that the master pin 15 is captured in the cut 23 and may be moved into alignment with a selected pinway 17 at one of the stations A through F. The handle 24 is then used to rotate the transfer tool 19 90° to cam the master pin 15 into that station C pinway 17. As shown in FIG. 5, the cam surface 25 positively holds the bottom-most master pin 15 in the pinway 17 with which the cut 23 is aligned. It may be understood that the position of the handle 24 (90° on either side of that shown in FIG. 8) indicates that the master pins 15 are retained in the various pinways 17 by either the cam surface 25 or the support surface 69 of the transfer tool 19. With the bottom-most master pin 15 transferred out of the station A pinway 17 and transferred directly into the station C pinway 17, the transfer tool 19 is kept in position with the handle 24 down. The transfer tool 19 is then slid outwardly in the guideway 59 to again position the cut 23 opposite to the station A pinway 17. The tool 19 is rotated 180° until the handle is up and the above steps are repeated to transfer the second master pin 15 into the station C pinway 17. The transfer tool 19 and the transfer key 20 are then removed from the keyway 13 and the second change key 27 is inserted (FIG. 9). The resulting re-keying of the lock 11 changes the heights of the tumbler stacks 52 so that the second change key 27 can have a deeper bitting depth at the bitting 31 at the station C and must have a shallower bitting depth at the bitting 26 at the station A from which the master pins 15 were transferred. Further, to be consistent with the bitting arrangement of the change keys 27 and 30, the station C bitting should be deeper so that the change key 27 will position the master pin 15 below the shear interface 45. In particular, referring to FIG. 9, the lock 11 is shown re-keyed and the second change key 27 inserted into the keyway 13. The second change key was bittings 22 of 547210, which positions the master pins 15 in station C below the shear interface 45 to allow the lock 11 to operate. It may be observed that the station A bitting 26 is cut to five depths, which is shallower than the nine depths at the A station 29 to which the first change key 30 is cut. If the C station of the second change key 27 were cut deeper than seven depths the lock 11 would not operate since the driver pin 43 would be across the shear interface 45.

While the preferred embodiment of the lock 11 is provided with the hole 67 for use of a relatively long transfer tool 19, a second preferred embodiment of the lock apparatus 10 of the present invention is shown in FIGS. 11A through 11E. There, five tools 70 through 74 are shown, the topmost one 70 of which permits transferring a master pin 15 from the forwardmost pinway 17 at the station A to the second pinway 17 at the station B and back again. The other transfer tools 71 through 74 permit the transfer of the master pins 15 between any two other adjacent pinways 17 without any of the transfer tools 71 through 74 extending rearwardly of the inside front of the retainer 46. The hole 67 in the retainer 46 is thus unnecessary and the lock 11 may be re-keyed while it is in the installed position.

Referring in greater detail to FIGS. 11A through 11E, the transfer tools 70 through 74 are shown. Considering the transfer tool 60, when indicator grooves 75 and 76 are aligned with the front edge 66 of the saddle 58, a cut 77 formed in the tool 70 is aligned respectively with the A station pinway 17 and the B station pinway 17. Similarly, the transfer tool 71 is provided with indicator grooves 78 and 79. When these indicator grooves 78 and 79 are aligned with the front edge 66 of the saddle 58 a cut 80 formed in the transfer tool 71 is aligned respectively with the stations B and C pinways 17. The same applies to the transfer tool 72 having indicator grooves 81 and 82 and a cut 83 therein. Thus, when the grooves 81 and 82 are successively aligned with the front edge 66 of the saddle 58, the cut 83 is successively aligned with the C and D station pinways 17 respectively. Similarly, the transfer tool 73 is provided with indicator grooves 84 and 85 for indicating alignment of a cut 86 with respective D and E station pinways 17. Finally, the transfer tool 74 is provided with indicator grooves 87 and 88 and a cut 89. Successive alignment of the grooves 87 and 88 with the front edge 66 of the saddle 58 successively aligns the cut 89 with the E and F station pinways 17. Each of the transfer tools is provided with the cam surface 25 and the support surface 69 as described above with respect to the transfer tool 19.

Still referring to FIGS. 11A through 11E and referring to FIG. 8, it may be understood that a leading end 90 of each of the transfer tools 70 though 74 will be positioned at a rearward end 91A of the housing 11 when the cut 77, 80, 83, 86 and 89 is aligned with the respective A, B, C, D and E station pinways 17. The support surfaces 69 of the transfer tools 70 through 74 thus extend under all of the driver pins 43 to support them and allow movement of the transfer tools 70 through 74 to the next adjacent and rearward pinway 17. The support surface 69 is similarly effective to support the driver pins 43 when each of the transfer tools 70 through 74 is positioned in its rearwardmost position. This allows each of the transfer tools 70 through 74 to move forwardly to the next forwardmost pinway 17.

The support surfaces 69 hold the driver pins out of the slot 14 during transfer of a master pin 15 into the respective ones of the cuts 77, 80, 83, 86 or 89 in the transfer tools 70 through 74. Thus, the transfer tools 70 through 74 may be slid along the transfer key 20 rearwardly to transfer the master pin 15 into alignment with the next adjacent pinway 17 without having the driver pin 43 of the adjacent pinway 17 interfere with the leading end 90 of the transfer tools.

Figure 13:
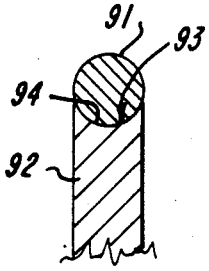
FIG. 13 is a vertical cross sectional view of the transfer tool shown in FIG. 12 illustrating a guideway formed in the transfer key.
Figure 12:
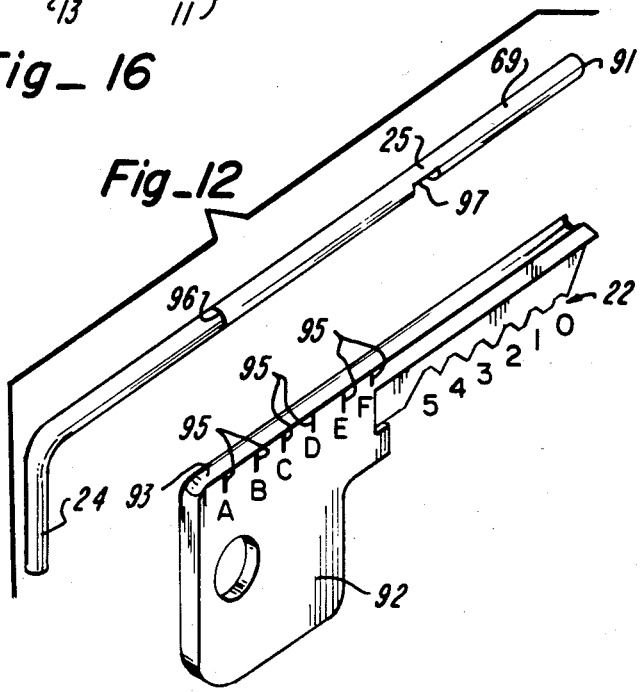
FIG. 12 is an exploded view of a third embodiment of the transfer key and the transfer tool of the present invention.

Referring now to FIGS. 12 and 13, a third embodiment of the present invention includes a transfer tool 91 and a transfer key 92. The transfer key 92 is provided with master key bittings 22 of 543210. The transfer key 92 is provided with a guideway 93 formed by an arcuate surface 94 (FIG. 13) that corresponds to the shape of the outer surface of the transfer tool 91. Indicator lines 95 on the transfer key 92 cooperate with a line 96 provided on the transfer tool 91 to indicate when a cut 97 provided in the tool 91 is aligned with the respective A through F station pinways 17. The cam surface 25, the support surface 69 and the handle 24 are also provided on the transfer tool 91. The operation of the transfer tool 91 and the transfer key 92 are the same as described above with respect to the transfer tool 19 and the transfer key 20, with the lines 95 and 96 corresponding to the grooves 60 through 65 and the edge 66.

TABLE 1

| Master Pin Positions | | | | | | Change Key | Change Key Bittings | | | | | |
|---|---|---|---|---|---|---|---|---|---|---|---|---|
| A | B | C | D | E | F | I.D. | A | B | C | D | E | F |
| 2 | | | | | | C1 | 9 | 4 | 3 | 2 | 1 | 0 |
| 2 | | | | | | | | | | | | |
| 2 | 2 | | | | | C2 | 7 | 6 | 3 | 2 | 1 | 0 |
| 2 | | 2 | | | | C3 | 7 | 4 | 5 | 2 | 1 | 0 |
| 2 | | | 2 | | | C4 | 7 | 4 | 3 | 4 | 1 | 0 |
| 2 | | | | 2 | | C5 | 7 | 4 | 3 | 2 | 3 | 0 |
| 2 | | | | | 2 | C6 | 7 | 4 | 3 | 2 | 1 | 2 |
| | 2 | | | | 2 | C7 | 5 | 6 | 3 | 2 | 1 | 2 |
| | 2 | | | 2 | | C8 | 5 | 6 | 3 | 2 | 3 | 0 |
| | 2 | | 2 | | | C9 | 5 | 6 | 3 | 4 | 1 | 0 |
| | 2 | 2 | | | | C10 | 5 | 6 | 5 | 2 | 1 | 0 |
| | 2 | | | | | C11 | 5 | 8 | 3 | 2 | 1 | 0 |
| | 2 | | | | | | | | | | | |
| | | 2 | | | | C12 | 5 | 4 | 7 | 2 | 1 | 0 |
| | | 2 | | | | | | | | | | |
| | | 2 | 2 | | | C13 | 5 | 4 | 5 | 4 | 1 | 0 |
| | | 2 | | 2 | | C14 | 5 | 4 | 5 | 2 | 3 | 0 |
| | | 2 | | | 2 | C15 | 5 | 4 | 5 | 2 | 1 | 2 |
| | | | 2 | | 2 | C16 | 5 | 4 | 3 | 4 | 1 | 2 |
| | | | 2 | 2 | | C17 | 5 | 4 | 3 | 4 | 3 | 0 |
| | | | 2 | | | C18 | 5 | 4 | 3 | 6 | 1 | 0 |
| | | | 2 | | | | | | | | | |
| | | | | 2 | | C19 | 5 | 4 | 3 | 2 | 5 | 0 |
| | | | | 2 | | | | | | | | |
| | | | | 2 | 2 | C20 | 5 | 4 | 3 | 2 | 3 | 2 |
| | | | | | 2 | C21 | 5 | 4 | 3 | 2 | 1 | 4 |
| | | | | | 2 | | | | | | | |

Referring now to Table 1, the advantages of the lock apparatus 10 and the methods of the present invention may be appreciated in terms of the many different change keys 27 and 30 that can be randomly used without disassembling the lock 11 or removing or replacing any master pins 15 therefrom or therein. Table 1 lists the exclusive master pin positions of a lock 11 provided with two, two-depth master pins 15 and change key bittings 22 based upon a master key 51 having bittings of 543210 and the tumbler pins 40 having heights of 543210. The use of the master pins 15 having a minimum of two-depths is preferred because the use of one-depth master pins 15 could result in the unintentional operation of a lock 11 with a change key 30 having one or more bittings 22 one depth deeper than the bittings 22 for which the lock 11 is set, a technique known as key picking, or pulling the key 30 outward to lift the tumbler pins 40, the master pins 15 and the driver pins 43, and jiggling the key 30 to separate the pins and obtain rotatable release of the plug 12. The six pinways 17 corresponding to the tumbler stations A through F (starting at the forwardmost pinway 17) correspond respectively in Table 1 to the letters A through F under the heading "Master Pin Positions". The six stations of the change keys 27 and 30 are correspondingly lettered A through F in Table 1 under the heading "Change Key Bittings". The shallowest bitting 22 is zero and the deepest bitting 22 is nine. Adding the depths of both master pins 15 in their various stations A through F to the depths of the bittings 22 of the master key 51 provides the bitting depths of the change keys 27 and 30. Listed in Table 1, along with master pin positions and change key bittings, are numbered change key designations for the change keys, such as the change keys 27 and 30. More particularly, to determine the bittings 22 for the "C1" change key 27, the master pin bittings of 543210 are increased by the depths of each master pin, which is two. Since two of the master pins 15 are at station A, the station A bitting 22 of the master key 51 is 5 plus the four depths of the two master pins 15 result in an A station bitting 22 of a depth 9 of the "C1" change key 27. As shown in Table 1, with only six pinways 17 and two master pins 15, the lock 11 of the present invention may be used with one master key 51 and 21 change keys, such as the change keys 27 and 30, each of which change keys has a unique combination of bittings 22. Once the slot 14 and hole 67 (if desired) are provided, the method described above may be used in conjunction with the Master Pin Positions shown in Table 1 to re-key the lock 11 without disassembly or removal or replacement of any of the master pins 15 therefrom or therein to render the lock 11 operable by a selected one of the change keys 27 and 30. Table 1 also shows that except for the change from the "C11" to the "C12" change keys and the change from the "C18" to the "C19" change key 27, only one master pin 15 need be transferred for a given re-keying. Further, as indicated above with respect to the re-keying from the "C1" change key 30 directly to the "C12" change key 27, such re-keying may be accomplished randomly and not in the sequence in which the change keys are identified in Table 1.

Figure 15:
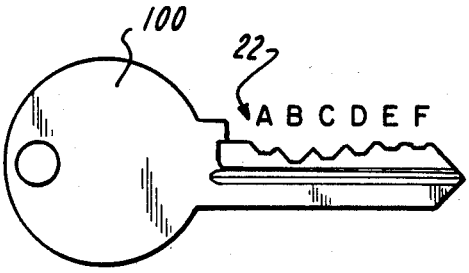
FIG. 15 is a side view of a sub-master key representing one of a series of sub-master keys that may be used with the lock of the second preferred embodiment of the present invention.
Figure 16:
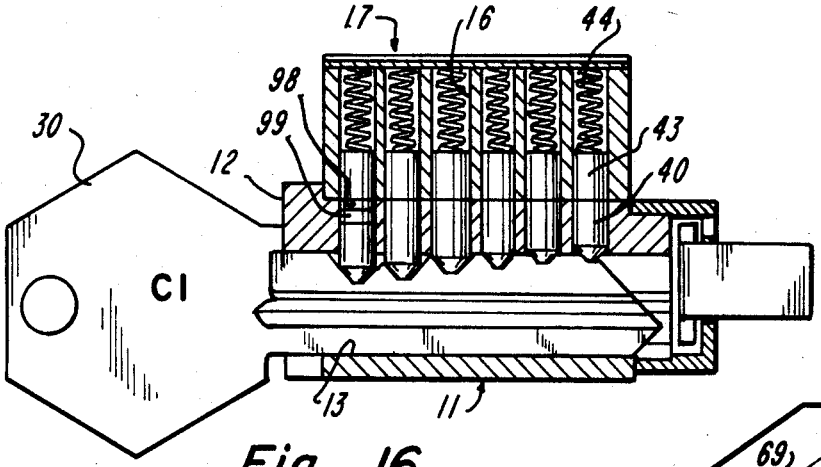
FIG. 16 is a vertical cross-sectional view of the lock of the present invention having tumbler pins and master pins for use of the lock with sub-master keys.

A third preferred embodiment of the lock apparatus 10 of the present invention includes the above described lock 11 shown in FIG. 16 in which the one or two master pins 15 appear in the form of a first master pin 98 having two-depths and a second master pin 99 having three-depths. This enables the lock 11 to be used with sub-master keys 100 (FIG. 15). Sub-master keys 100 can be used with a selected number of different change keys, such as the change keys 27 and 30. Table 2 identifies a series of 36 change keys, which may be the change keys 27 and 30, that may be randomly selected for use with the lock 11 by the above-described use of the transfer tool 19 and the transfer key 20. Table 2 shows the station positions of the master pins 98 and 99 and the identification of the corresponding change keys 27 and 30 for use with the particular master pin positions. Also shown are the particular bittings for the identified change keys 27 and 30. The submaster keys 100 usable with the various settings of the lock 11 are represented in FIG. 15 as having bittings of 343210, for example, usable with the C1 through C6 change keys 27 and 30. A similar sub-master key 100 having bittings of 073210 would be used when the lock 11 is keyed for use by the C7 through C12 change keys and similarly one having bittings 046210 for the C13 through C18 change keys, one having bittings 043510 for the C19 through C24 change keys, one having bittings 043240 for the C25 through C30 change keys, and one having bittings 043213 for the C31 through C36 change keys.

Figure 14:
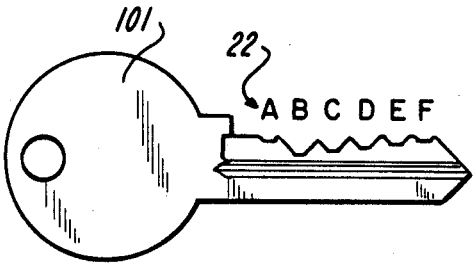
FIG. 14 is a side view of a master key shown having bittings for operating a lock of the second preferred embodiment of the present invention in which the lock may be used with sub-master keys.

The lock 11, provided with the two-depth and three-depth master pins 98 and 99, would be used with a master key 101 shown in FIG. 14 having bittings of 043210.

TABLE 2

| Master Pin Positions | | | | | | Change Key | Change Key Bittings | | | | | |
|---|---|---|---|---|---|---|---|---|---|---|---|---|
| A | B | C | D | E | F | I.D. | A | B | C | D | E | F |
| 2 | | | | | | C1 | 5 | 4 | 3 | 2 | 1 | 0 |
| 3 | | | | | | | | | | | | |
| 3 | 2 | | | | | C2 | 3 | 6 | 3 | 2 | 1 | 0 |
| 3 | | 2 | | | | C3 | 3 | 4 | 5 | 2 | 1 | 0 |
| 3 | | | 2 | | | C4 | 3 | 4 | 3 | 4 | 1 | 0 |
| 3 | | | | 2 | | C5 | 3 | 4 | 3 | 2 | 3 | 0 |
| 3 | | | | | 2 | C6 | 3 | 4 | 3 | 2 | 1 | 2 |
| | 3 | | | | 2 | C7 | 0 | 7 | 3 | 2 | 1 | 2 |
| | 3 | | | 2 | | C8 | 0 | 7 | 3 | 2 | 3 | 0 |
| | 3 | | 2 | | | C9 | 0 | 7 | 3 | 4 | 1 | 0 |
| | 3 | 2 | | | | C10 | 0 | 7 | 5 | 2 | 1 | 0 |
| | 2 | | | | | C11 | 0 | 9 | 3 | 2 | 1 | 0 |
| | 3 | | | | | | | | | | | |
| 2 | 3 | | | | | C12 | 2 | 7 | 3 | 2 | 1 | 0 |
| 2 | | 3 | | | | C13 | 2 | 4 | 6 | 2 | 1 | 0 |
| | 2 | 3 | | | | C14 | 0 | 6 | 6 | 2 | 1 | 0 |
| | | 2 | | | | C15 | 0 | 4 | 8 | 2 | 1 | 0 |
| | | 3 | | | | | | | | | | |
| | | 3 | 2 | | | C16 | 0 | 4 | 6 | 4 | 1 | 0 |
| | | 3 | | 2 | | C17 | 0 | 4 | 6 | 2 | 3 | 0 |
| | | 3 | | | 2 | C18 | 0 | 4 | 6 | 2 | 1 | 2 |
| | | | 3 | | 2 | C19 | 0 | 4 | 3 | 5 | 1 | 2 |
| | | | 3 | 2 | | C20 | 0 | 4 | 3 | 5 | 3 | 0 |
| | | | 2 | | | C21 | 0 | 4 | 3 | 7 | 1 | 0 |
| | | | 3 | | | | | | | | | |
| | | 2 | 3 | | | C22 | 0 | 4 | 5 | 5 | 1 | 0 |
| | 2 | | 3 | | | C23 | 0 | 6 | 3 | 5 | 1 | 0 |
| 2 | | | 3 | | | C24 | 2 | 4 | 3 | 5 | 1 | 0 |
| 2 | | | | 3 | | C25 | 2 | 4 | 3 | 2 | 4 | 0 |
| | 2 | | | 3 | | C26 | 0 | 6 | 3 | 2 | 1 | 0 |
| | | 2 | | 3 | | C27 | 0 | 4 | 5 | 2 | 4 | 0 |
| | | | 2 | 3 | | C28 | 0 | 4 | 3 | 4 | 4 | 0 |
| | | | | 2 | | C29 | 0 | 4 | 3 | 2 | 6 | 0 |
| | | | | 3 | | | | | | | | |
| | | | | 3 | 2 | C30 | 0 | 4 | 3 | 2 | 4 | 2 |
| | | | | | 2 | C31 | 0 | 4 | 3 | 2 | 1 | 5 |
| | | | | | 3 | | | | | | | |
| | | | | 2 | 3 | C32 | 0 | 4 | 3 | 2 | 3 | 3 |
| | | | 2 | | 3 | C33 | 0 | 4 | 3 | 4 | 1 | 3 |
| | | 2 | | | 3 | C34 | 0 | 4 | 5 | 2 | 1 | 3 |
| | 2 | | | | 3 | C35 | 0 | 6 | 3 | 2 | 1 | 3 |
| 2 | | | | | 3 | C36 | 2 | 4 | 3 | 2 | 1 | 3 |

As shown in FIG. 16, the lock 11 for use with sub-master keys 100 is provided with tumbler pins 40 having heights of 043210. FIG. 16 shows the first change keys 30 as the "C1" change key identified in Table 2. As shown in Table 2 and in FIG. 16, the master pins 98 and 99 are positioned in the A station pinway 17 below the shear interface 45 by the "C1" first change key 30. To re-key the lock 11 for use by any one of the other 35 randomly selectable change keys 27 shown in Table 2, the "C1" change key 30 is removed from the keyway 13 and the transfer key 20 is inserted therein. For use in the third preferred embodiment, the transfer key 29 is provided with the bittings of the master key 101, which are 043210. The transfer tool 19 is inserted into the keyway 13 and the re-keying operation is performed as described above with respect to the first preferred embodiment. As a result of such re-keying operation, one or both of the master pins 98 or 99 is randomly and selectively repositioned to a different one of the A through F station pinways 17 such that the second change key 27 having the bittings 22 identified in Table 2 is the only change key effective to operate the lock.

Once re-keyed, such second change key 27, for example the "C18" change key, would be usable to operate the lock. Also, in the example of the "C18" second change key 27, the sub-master key 100 would be provided with bittings of 046212 for use with the lock 11 when it is keyed for operation by the "C18" through "C23" change keys 27.

90° Lock Apparatus 102

Figure 17:
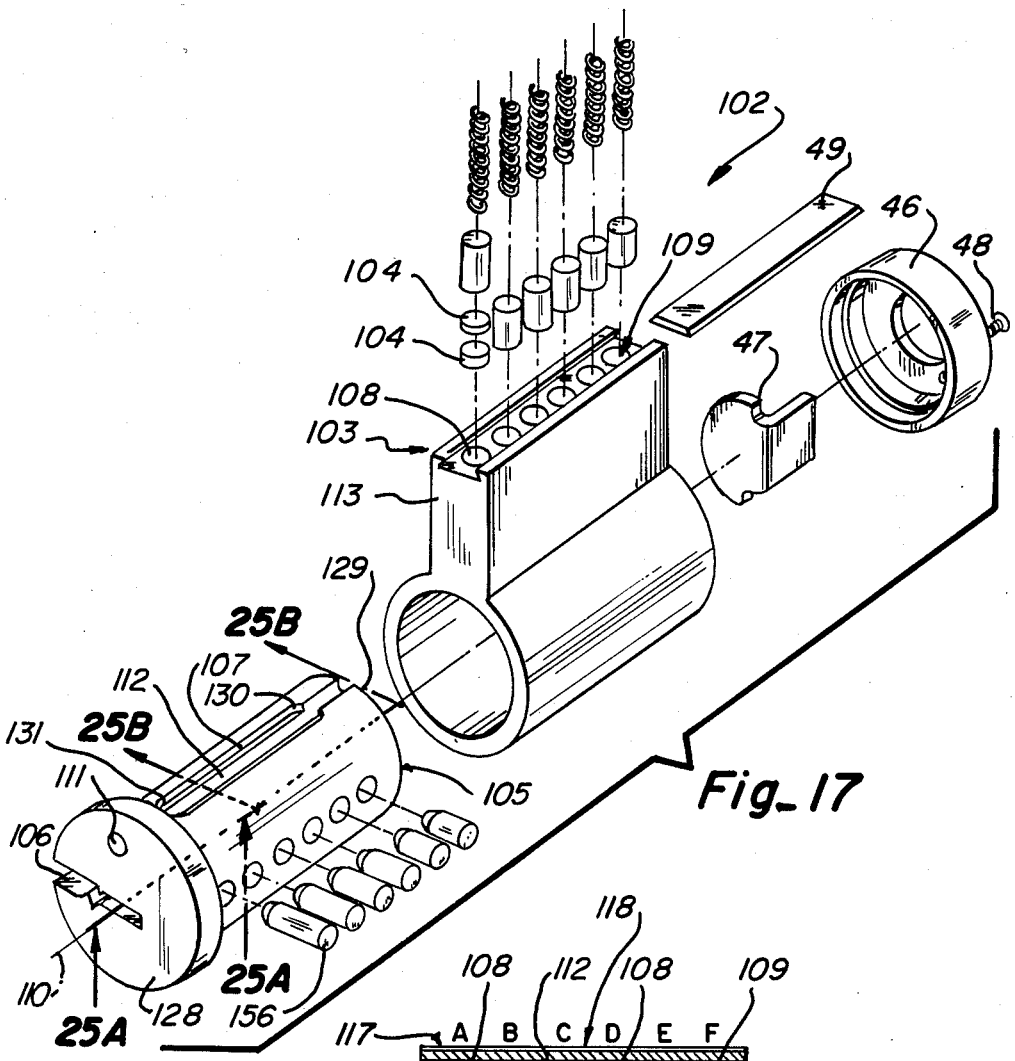
FIG. 17 is an exploded view of the modified 90° lock with the plug rotated 90° from a locking position.

Referring to FIG. 17, a fourth preferred embodiment of the present invention is shown as including a lock apparatus 102 that may be used to perform the methods of the present invention to render a standard 90° pin tumbler lock 103 re-keyable and to re-key the 90° lock 103 without disassembling the lock 103 or removing any master pins 104 from or replacing any master pins 104 to the 90° lock 103. A cylindrical plug 105 of the 90° lock 103 has a keyway 106. The keyway 106 is shown positioned 90° from a slot 107 having a width and depth sufficient for receiving one of the master pins 104 from a top portion 108 of one of a series of pinways 109. The slot 107 has a limited length in the direction of the longitudinal axis 110 of the lock 103 to prevent removal of the master pin 104 from the lock 103. A hole 111 is drilled in the plug 105 in alignment with the slot 107 to form a groove 112 that extends into the slot 107.

In the method of rendering the 90° lock 103 rekeyable, if the lock 103 has been assembled, the plug 105 is removed from a housing 113 to facilitate forming the slot 107, the hole 111 and the groove 112 in the plug 105, whereafter the plug 105 is replaced in the housing 113. A blocking rod 114 (FIGS. 18 and 23A) is then inserted into the hole 111 to fill the groove 112 and the slot 107 during normal (non-re-keying) use of the 90° lock 103.

For re-keying the 90° lock 103, with the 90° lock 103 locked, the blocking rod 114 is removed from the groove 112 and the hole 111. In the context of "disassembling" a lock, such removal of the blocking rod 114 is not considered as disassembling the 90° lock 103. On the other hand, an operation generally performed by a locksmith, such as removal of the plug 105 from the housing 113, for example, would be considered "disassembly" of the 90° lock 103.

A transfer tool 115 (FIGS. 20, 21 and 26) is slidably inserted into the hole 111 and the groove 112 and extends within the slot 107. After the 90° lock 103 is unlocked, a cut 116 (FIGS. 20, 21 and 26) formed in the transfer tool 115 is positioned to receive the master pin 104 from a first pinway 117 of the series of pinways 109 (station A, for example, FIG. 18). The transfer tool 115 is slidable relative to the groove 112 and within the slot 107 for repositioning the master pin 104 randomly and directly from the first pinway 117 to any second pinway 118 (station C, for example) without removing the master pin 104 from the lock 103. The transfer tool 115 is provided with a handle 119 (FIG. 26) for rotating the tool 115 relative to the groove 112 and the slot 107 so that the master pin 104 rides out of the cut 116 and the slot 107 onto a cam surface 120 (FIGS. 20 and 26) that lifts the master pin 104 and positively inserts it into the second pinway 118.

With the master pin 104 transferred from the first pinway 117 into the second pinway 118, a bitting 121 for station A (corresponding to the first pinway 117) of a second change key 122 (FIG. 25A) must be shallower than the station A bitting 29 of the original or first change key, which may be the change key 30 shown in FIG. 7. Also, and still comparing to the first change key 30 in FIG. 7, a station C bitting 123 (for the second pinway 118) of the second change key 122 can, and should, be deeper than the station C bitting 32 of the original or first change key 30 to operate the 90° lock 103.

Figure 20:
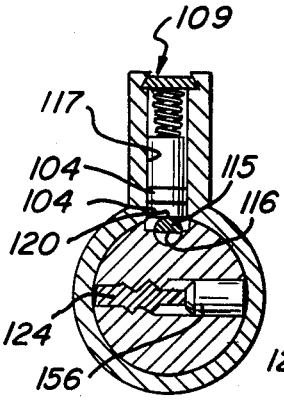
FIG. 20 is similar to FIG. 19, but shows the transfer tool inserted in a groove in the plug and the plug rotated 90° to position the transfer tool under the pinways, with a cam on the transfer tool holding the master pins in a pinway.

The method of re-keying the 90° lock 103 according to the present invention includes removing the blocking rod 114 from the hole 111, the groove 112 and the slot 107. The transfer tool 115 is then inserted into the hole 111 and the groove 112 so that it extends within the slot 107, with the cut 116 of the transfer tool 115 axially aligned with the first pinway 117 (station A, FIG. 18) that contains the master pin 104. A master key 124 is then used to unlock the 90° lock 103. The handle 119 is rotated to move the cut 116 into position (FIG. 21) for receiving the master pin 104. The transfer tool 115 is then slid along the groove 112 to align the master pin 104 with the second pinway 118 (station C, FIG. 25A). The second pinway 118 can be any one of the other pinways of the series of pinways 109. The handle 119 is again rotated so that the master pin 104 rides up onto the cam surface 120 and is positively inserted into the second pinway 118. FIG. 20 shows such insertion in respect to the forwardmost pinway 117. The master key 124 and the transfer tool 115 are then rotated with the plug 105 to their original position, and the master key 124 and the transfer tool 115 are removed from the keyway 106, and from the hole 111 and the groove 112, respectively, leaving the 90° lock 103 ready to accept the second change key 122 (FIG. 25A) that has the bittings 121 and 123 and other bittings adapted to operate the 90° lock 103. The 90° lock 103 is ready for use of the second change key 122 upon reinsertion of the blocking rod 114 into the hole 111 and the groove 112, to extend within the slot 107.

Figure 21:
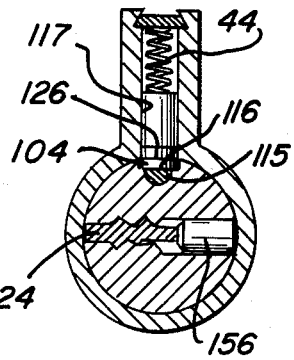
FIG. 21 is similar to FIG. 20, but shows the transfer tool rotated 180° and the master pin received in a cut in the transfer tool opposite to the cam.

Referring now to FIGS. 17, 20 and 21, it may be understood that the 90° lock 103 is of usual construction prior to modification to form the slot 107, the hole 111 and the groove 112. The slot 107 is wide enough to receive the master pin 104. The slot 107 is also shown deep enough so that the top 126 (FIG. 21) of one master pin 104 that is received in the slot 107 is in a shear interface 127 (see FIG. 22) so that such master pin 104 can move in the slot 107 directly from the pinway 117 at station A, for example, to a randomly selectable pinway, such as pinway 118 at station C.

Figure 18:
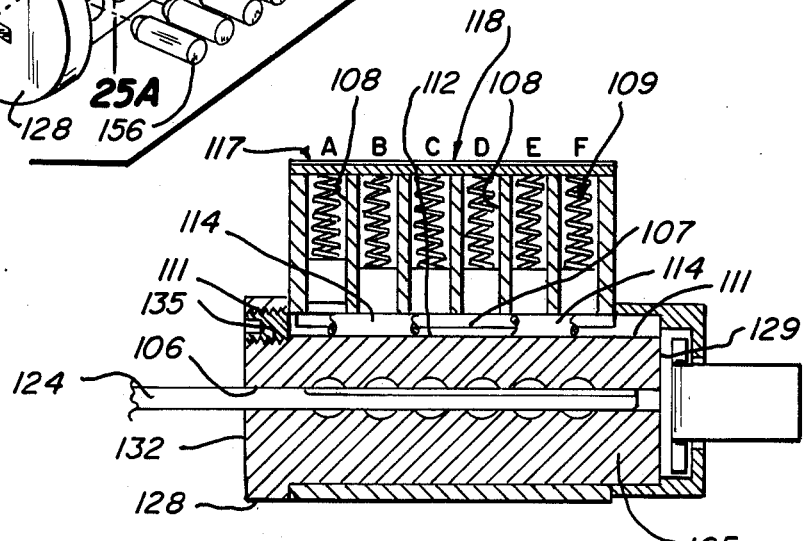
FIG. 18 is a partial vertical transverse cross sectional view through the center of the assembled, modified 90° lock after a master key has unlocked the 90° lock, showing a master pin in a randomly selected, initial pinway and a blocking rod holding the master pin in the initial pinway.

As shown in FIG. 18, the plug 105 has a forwardmost or front end 128 (to the left) and a rearward end 129. The slot 107 has a shoulder 130 (see FIG. 17) adjacent station F at the rearward end 129 to prevent movement of the master pin 104 out of the rear of the slot 107. When the master pin 104 is adjacent the shoulder 130 it is aligned with station F. A shoulder 131 near the front end 128 prevents movement of the master pin 104 out of the front of the slot 107. When the master pin 104 is adjacent the shoulder 131 it is aligned with the first pinway 117 at station A.

Figure 19:
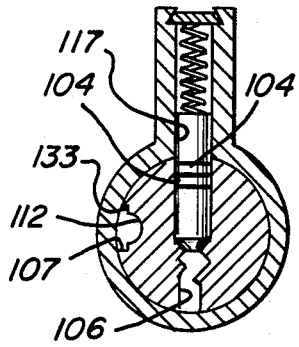
FIG. 19 is a partial vertical cross section through the center of the forwardmost pinway of a modified 90° lock, with a tumbler pin, two master pins, a driver pin and a spring shown full bodied in a locked position, where the blocking rod shown in FIG. 18 has been removed prior to insertion of a transfer tool.

FIGS. 18 and 19 show the hole 111 drilled in a front face 132 of the plug 105. The hole 111 extends through the front shoulder 131 and intersects a bottom 133 of the slot 107 to form the groove 112 (FIG. 19). The groove 112 thus extends the full length of the slot 107. The hole 111 continues through the rear shoulder 130 to the rearward end 129 of the plug 105.

Figure 22:
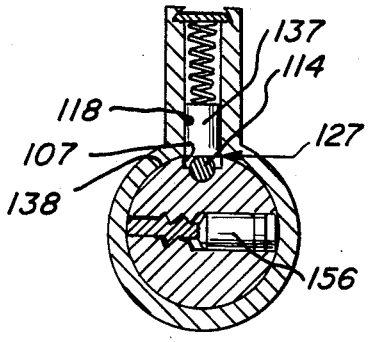
FIG. 22 is a view similar to FIG. 20, but shows the C station pinway to which the master pins have been moved in the re-keying operation, in which the transfer tool has been removed from the 90° lock and a blocking member has been inserted into the groove, so that in the depicted unlocked position of the plug the driver pin in the forwardmost pinway is maintained in the housing portion of such pinway.
Figure 23A:
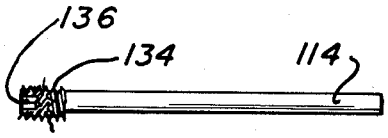
FIG. 23A is an elevational view of a one piece blocking rod having an externally threaded end for removably holding the rod in the groove.

As shown in FIG. 18, the hole 111 and the groove 112 receive the blocking rod 114. FIG. 23A shows a first preferred embodiment of the blocking rod 114, in which it is in one piece and is removably received in the hole 111 and the groove 112. The left (or front) end 134 of the blocking rod 114 is externally threaded to cooperate with the threads 135 tapped into the portion of the hole 111 that is in the front shoulder 131. The front end 134 of the blocking rod 114 is also provided with a recess 136, that may be a standard hexagonal or other shaped socket for unscrewing the blocking rod 114 and removal thereof from the hole 111 and the groove 112. This is usually done before the 90° lock 103 is unlocked, but need only be done before the slot 107 and the groove 112 are rotated with the plug 105 into the fully unlocked position shown in FIGS. 20 through 22 at which re-keying is performed. As shown in FIG. 22, with the plug 105 in the re-keying, unlocking position, the blocking rod 114 prevents a driver pin 137 from entering the slot 107 and preventing rotation of the plug 105. Instead, the driver pin 137 rests on the blocking rod 114 and is aligned with the outer surface 138 of the plug 105 and the shear interface 127 so that the plug 105 is free to rotate.

Figure 23B:
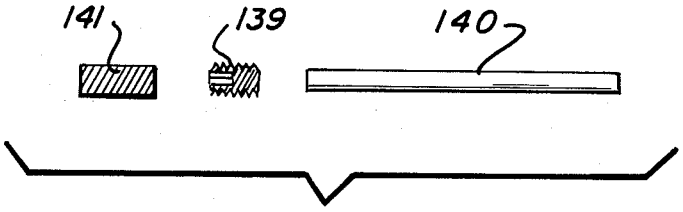
FIG. 23B is an elevational view of a two piece blocking rod, where the first piece is made of magnetic material and is first inserted into the groove, and the second piece is externally threaded for removably holding the first piece in the groove.

A second preferred embodiment of the blocking rod 114 is shown in FIG. 23B in the form of a set screw 139 and a separate rod 140. The separation of the rod 140 from the set screw 139 is so that the rod 140 is not removed from the threaded portion 135 of the hole 111 with the set screw 139. This reduces the risk of tempering with the 90° lock 103, since the rod 140 is thus less easily observed. The rod 140 is made from magnetic material so that it is not easily removed from the hole 111 without a magnet 141.

Figure 26:
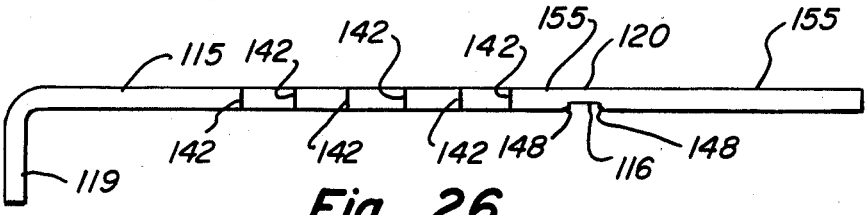
FIG. 26 is an elevational view of the transfer tool for use with the 90° lock.

Referring to FIG. 26, there is shown a first preferred embodiment of the transfer tool 115. The transfer tool 115 has six circumferential rings or marks 142. Each mark 142 acts, in conjunction with the front face 132 of the plug 105, as an index or indicator to show when the cut 116 is opposite to a particular one of the tumbler stations A through F of the 90° lock 103. The transfer tool 115 also is shown having the cut 116 having a depth equal to that of the master pin 104 with which it is to be used, e.g. a two-depth thickness. For use with a three-depth master pin 104, a second transfer tool 115 having a three-depth cut 116 would be used. To avoid use to two such transfer tools 115, the cut 116 can be chamfered as described below with respect to FIGS. 24A through 24E.

Referring to FIG. 6, the 90° lock 103 may also be provided with the hole 67 in the retainer 46 for allowing the transfer tool 115 to extend rearwardly of the retainer 46 so that the cut 116 may be aligned with all of the various pinways 109 at the stations A through F.

While the preferred embodiment of the 90° lock 103 is provided with the hole 67 to permit use of a relatively long transfer tool 115, a second preferred embodiment of the 90° lock apparatus 102 of the present invention is shown in FIGS. 24A through 24E. There, five tools 143 through 147 are shown, the topmost one 143 of which permits transferring a master pin 104 from the forwardmost pinway 117 at the station A to the second pinway 109 at station B and back again. The other transfer tools 144 through 147 permit the transfer of the master pins 104 between any two other pinways 109 without any of the transfer tools 143 through 147 extending rearwardly of the inside front of the retainer 46. The hole 67 in the retainer 46 is thus unnecessary and the 90° lock 103 may be re-keyed while it is in the installed position.

Referring in greater detail to FIGS. 24A through 24E, and first considering the transfer tool 143, when indicator rings 142 are aligned with the front face 132 of the plug 105, the cut 116 formed in the tool 143 is aligned respectively with the A station pinway 117 and the B station pinway 109. The transfer tools 144, 145, 146 and 147 are similarly designed to be aligned with respective B and C, C and D, D and E, and E and F stations.

Each of the transfer tools 115 and 143 through 147 is provided with the cam surface 120 opposite to the cut 116. However, to illustrate another embodiment of the 90° lock apparatus 102, the transfer tools 143 through 147 are also provided with a three-depth cut 116 for universal use with both two and three-depth master pins 104. To facilitate such use, at each end of the cut 116 in the direction of the longitudinal axis 110, a chamfer 148—148 is provided. When a two-depth master pin 104 is received in the three-depth cut 116, the driver pin 137 would normally enter such cut 116 and prevent movement of the transfer tools 143 through 147 along the groove 112. However, when the transfer tools 143 through 147 are moved, the chamfers 148—148 cause the driver pin 137 to ride up or be cammed out of such cut 116 onto the outer surface 149 so tha the transfer tools 143 through 147 can move the master pin 104 to the next pinway 109. If desired, the chamfers 148—148 can also be provided on the transfer tool 115 to perform a similar purpose.

The 90° lock apparatus 102 also includes the master key 124 shown in FIGS. 18, 20 and 21. The master key 124 has bittings that correspond to the 543210 bittings 22 shown in FIG. 12 on the transfer key 92. As a result, when the master key 124 is used to initiate a re-keying operation, a master pin 104 will always be positioned above the shear interface 129 before the plug 105 is rotated to the unlocked, re-keying position.

Figure 27:
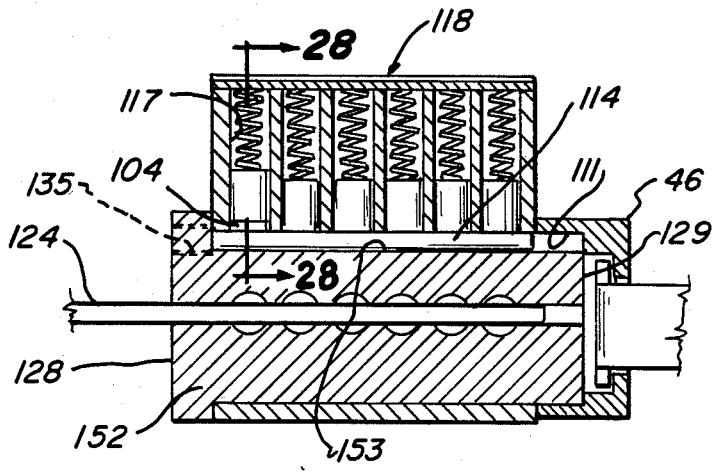
FIG. 27 is a partial vertical transverse cross sectional view through the center of the assembled 90° lock showing a master pin in an initial pinway, a master key having rotated the plug into an unlocked position, and the slot in the form of a U-shaped groove that extends from a front shoulder to the rearward end of the plug.
Figure 28:
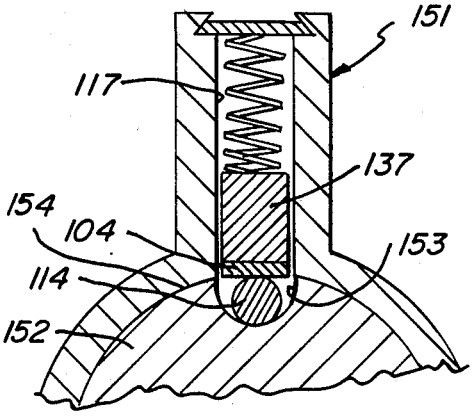
FIG. 28 is a cross section taken along line 28—28 in FIG. 27 showing the U-shaped groove and the blocking rod received in the groove.
Figure 29:
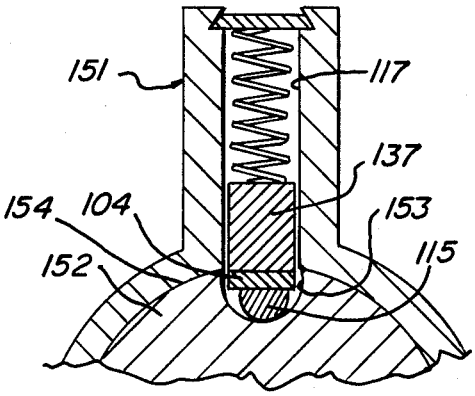
FIG. 29 is a cross section taken along line 28—28 in FIG. 27 after removal of the blocking rod from the groove and insertion of the transfer tool into the U-shaped groove, showing a master pin carried by the cut in the transfer tool.

A further preferred embodiment of the 90° lock 103 of the present invention is shown as the 90° lock 151 in FIGS. 27 through 29. There, a plug 152 is shown with the hole 111 drilled into the front end 128 of the plug 152. The portion of the hole 111 that is in the front end 128 is also tapped at 135 to secure the blocking rod 114 or the set screw 139 (see FIGS. 23B). The front shoulder 131 (shown in FIG. 17) is provided for preventing movement of the master pins 104 frontwardly past the station A pinway 117. To the right (or rearwardly) of the front shoulder 131 there is a semi-circular, U-shaped groove 153 formed in the outer surface 154 of the plug 151 at the same circumferential location as the slot 107 is formed in the plug 105. The U-shaped groove 153 extends from the front shoulder 131 to the rear end 129 of the plug 152. The U-shaped groove 153 is shown in FIGS. 28 and 29 being wide enough and deep enough to receive one of the master pins 104, such that the top 126 (FIG. 21) is aligned with the shear interface 127 (FIG. 22). In FIG. 28 the blocking rod 115 is shown received in the U-shaped groove 153 and preventing the master pin 104 from entering the U-shaped groove 153. This is the same function as that shown performed in FIG. 22 by the blocking rod 114 in respect to the groove 112 and the slot 107. FIG. 29 depicts the portion of the transfer tool 115 that extends rearwardly of the front shoulder 131 into the U-shaped groove 153. The cut 116 is positioned under a selected one of the pinways 109 for receiving the master pin 104, so that upon movement of the transfer tool 115 along the U-shaped groove 153 the master pin 104 is positioned for transfer into a randomly selected pinway 109. The extension of the U-shaped groove 153 to the rearward end 129 of the plug 152 does not raise the risk of a master pin 104 being accidentally removed from the plug 152 since it is in the cut 116 when it is in the U-shaped groove 153. Further, when the lock apparatus 102 is installed for operation, the mechanism (not shown) behind the 90° lock will prevent the transfer tool 115 from moving rearwardly enough to allow the cut 116, and thus the master pin 104, to move out of the housing 113. With the 90° lock 103 removed from its installed location, such as from a door (not shown), there is less concern about loss of the master pin 104. The re-keying operation is performed in the same manner as with the plug 105 having the slot 107 and the groove 112. However, it is sometimes desirable to change the number of master pins 104 in the 90° lock 151 or to exchange master pins 104. For these purposes, after removal of the retainer 46 from the plug 152, the transfer tool 115 is inserted into the front end of the U-shaped groove 153. The transfer tool 115 is long enough to extend completely through the U-shaped groove 153 so that the cut 116 is past the rearward end 129 (FIG. 27) of the 90° lock 151. The extension of the U-shaped groove 153 to the rearward end 129 enables one to insert or remove a master pin 104 from the 90° lock 151 in a manner similar to that for transferring the master pin 104 from one pinway 109 to another pinway 109. In particular, since the cut 116 and a master pin 104 can thus move outside the lock apparatus 102, a master pin 104 received in the cut 116 from a pinway 109 can be removed from the lock 151, or a master pin 104 can be inserted into the cut 116 for movement with the U-shaped groove 153 to a randomly selected pinway 109 of the block 151.

Re-keying The 90° Lock Apparatus 102

Referring now to FIG. 18, the 90° lock 103 is shown having the master key 124 inserted into the keyway 106. Also, the blocking rod 114 is received in the hole 111 and the groove 112. The 90° lock 103 may be provided with two two-depth master pins 104 or with one two-depth and one three-depth master pin 104. Table 2 above can be used as a guide for re-keying the 90° lock 103 if it is provided with the one two-depth master pin 104 and the one three-depth master pin 104. The re-keying operation of the 90° lock 103 is described below with two, two-depth master pins 104 as shown in FIGS. 19 through 22 and 25A, and as described in Table 1 above.

To initiate re-keying the 90° lock 103, the plug 105 is in the locked position shown in FIG. 19, and the master key 124 may or may not be in the keyway 106. A male socket tool (not shown) is inserted into the socket 136 and the blocking rod 114 is rotated, unscrewed and removed from the hole 111 and the groove 112. The transfer tool 115, or the appropriate transfer tool 143 through 147, is inserted into the hole 111 and moved along the groove 112 until the transfer tool 115 extends beyond the rear shoulder 130. When the transfer tool 115 is initially inserted into the hole 111 and the groove 112, the handle 119 is located outside of the 90° lock 103. In terms of FIG. 19, the handle 119 would be horizontal and to the right and in FIG. 20 the handle would be down so that the cam surface 120 is at the shear interface 129 as shown in FIG. 20. After the master key 124, the transfer tool 115 and the plug 105 have been rotated as a unit into the position shown in FIG. 20, the cam surface 120 adjacent the cut 116 is facing upwardly and is adjacent the pinway 117, at station A. The cam surface 120 retains the lower master pin 104 in the pinway 117 at station A. Further, a laterally extending support surface 155 of the transfer tool 115 (FIG. 26) extends under each of the pinways 109 at the stations B through F to retain the respective driver pin 137 and/or master pin 104 in the respective pinways 109.

The handle 119 is then used to move the transfer tool 115 longitudinally along the groove 112 within the slot 107 to position the cut 116 under but rotated 180° away from a selected pinway 109, shown in FIG. 20 as the pinway 117 at station A. The alignment of the cut 116 is indicated by one of the rings 142 and the front face 132. The support surface 155 supports the driver pins 137 and the cam surface 120 supports the master pins 104. The transfer tool 115 is then rotated 180° to the position shown in FIG. 21, so that the bottom-most master pin 104 is biased into the cut 116 by the spring 44. The "up" position of the handle 119 (inverted from the shown in FIG. 26) indicates that the cut 116 is in position to receive the bottom-most master pin 104. If the transfer tool 115 is then rotated at least 90° in either direction from that shown in FIG. 21 to that shown in FIG. 5, the master pin 104 (shown there as 15) rides up onto the cam surface 120 (there shown as 25) out of the cut 116 and is thus forced or cammed back into the pinway 117 at station A.

In re-keying the 90° lock 103, the master pin 104 is in the cut 116 as shown in FIG. 21. The transfer tool 115 is then moved longitudinally along the groove 112 to place the cut 116 and the master pin 104 therein opposite to a pinway 109 at a randomly selectable, different one of the tumbler stations B through F. In the example of re-keying the 90° lock 103 for use of the C12 second change key 27 listed in Table 1, the lower master pin 104 is transferred to the C station pinway 118. The handle 119 is then used to rotate the transfer tool 115 90° to cam the master pin 104 into that station C pinway 118. As shown in FIG. 20 with respect to the A station pinway 117, the cam surface 120 positively holds the bottom-most master pin 104 in the pinway. The cam surface 120 functions the same at station C. The down position of the handle 119 (FIGS. 24A and 26) indicates that the master pin 104 at station C is retained in the pinway 117 by the cam surface 120 and the driver pins 137 and the station A master pin 104 are kept in the top pinway portions 108 by the support surface 155 of the transfer tool 115. With the lower master pin 104 transferred out of the station A pinway 117 and transferred directly into the station C pinway 118, the transfer tool 115 is kept in position with the handle 119 down. To complete the re-keying to the C12 change key 27 listed in Table 1, the transfer tool 115 is then slid outwardly in the groove 112 to again position the cut 116 opposite to the station A pinway 117. The transfer tool 115 is rotated 180° until the handle 119 is up and the above steps are repeated to transfer the second master pin 104 into the station C pinway 109. At this juncture, both of the master pins 104 are in the station C pinway 118. The transfer tool 115 and the master key 124 are then rotated with the plug 105 to the position shown in FIG. 19. The master key 124 and the transfer tool 115 are then removed from the lock 103. According to Table 1, with the 90° lock 103 now having the two two-depth master pins 104 in the station C pinway 118, the C12 second change key 27 is inserted into the keyway 106. The blocking rod 114 is inserted into the hole 111 and the groove 112, extends within the slot 107, and is rotated to be secured by the threads 135 in the hole 111. The blocking rod 114 then functions as shown in FIG. 25B when the second C12 change key 27 is used.

The 90° locks 103 and 151 of the present invention may also be used with various change keys 27 and 30, master keys 51 and sub-master keys 100 as discussed with respect to the 180° lock apparatus 10. Thus, the depths and positions of the master pins 104 of the 90° lock apparatus 102 may be as described in Table 1 or Table 2, as desired. Also, the master key 124 may have the same 543210 bittings as the master key 51 and the tumbler pins 156 may have the same 543210 heights as the tumbler pins 40 have.

While the preferred embodiments have been described in order to illustrate the fundamental relationships of the present invention, it should be understood that numerous variations and modifications may be made to these embodiments without departing from the teachings and concepts of the present invention. Accordingly, it should be clearly understood that the form of the present invention described above and shown in the accompanying drawings is illustrative only and is not intended to limit the scope of the invention to less than that described in the following claims.

What is claimed is:

1. In a lock including a housing; a bore extending through said housing parallel to an axis; a plug having a cylindrical surface and being received in said bore; said housing and said plug defining a shear interface and having aligned holes therein forming portions of and combining to form a plurality of pinways that are spaced in the direction of said axis and that are divided by said shear interface; said plug being rotatably received in said bore; a first tumbler stack including a first tumbler pin, a first driver pin and at least one master pin being received in said first pinway; said master pin separating said first driver pin from said first tumbler pin; a second tumbler stack in said second pinway and including a second driver pin and a second tumbler pin; and a keyway formed in said plug and extending from said holes in said plug to said cylindrical surface of said plug; the improvement comprising:

means formed in said surface of said plug spaced from said keyway for guiding a master pin from one of said pinways to another of said pinways; and means received in said guiding means for preventing said master pin from being received in said guiding means, said preventing means being removable from said guiding means to selectively permit reception of said master pin in said guiding means.

2. A lock as recited in claim 1, wherein:

said guiding means is a guideway having a width and depth for receiving said master pin;

shoulder means is provided at the front of said guideway for preventing removal of said master pin from said lock, said shoulder means being aligned with said first pinway at the front of said plug, said shoulder means preventing said master pin from moving forwardly in said guideway and out of said lock without disassembly of said lock and permitting said master pin to move randomly in said guideway between said pinways; and said preventing means is an elongated rod having a diameter at least equal to the depth of said guideway and a length at least equal to the distance from said shoulder means to said second tumbler stack so that upon unlocking of said lock and rotation of said plug to align said guideway with said holes in said housing, said master pin rests on said rod and is not received in said guideway.

3. A lock as recited in claim 1, wherein:

said guiding means is provided with spaced shoulder means for preventing removal of said master pin from said lock;

said guiding means is provided with extensions formed beyond both of said spaced shoulder means, said extensions being dimensioned to receive said preventing means but not said master pin; and said preventing means is removable from said lock through one of said extensions.

4. In a lock apparatus, including a lock as recited in claim 1 and receiving means for use in re-keying said lock, wherein:

said guiding means is provided with shoulder means for preventing removal of said master pin the front of from said lock; and said receiving means is adapted to be received in said guiding means upon removal of said preventing means from said guiding means for receiving said master pin from said housing portion of said first pinway, said receiving means is slidable along said guiding means for moving said master pin rearwardly of said shoulder means to reposition said master pin adjacent said second pinway without removal of said master pin from or disassembly of said lock, said receiving means is rotatable relative to said guiding means to transfer said master pin from said guiding means into said second pinway to change the height of said second tumbler stack in said second pinway without removal of said master pin from said lock.

5. A lock apparatus as recited in claim 4, wherein:

said guiding means includes a guideway having a width and depth for receiving said master pin;

said shoulder means defines a front and a rear shoulder at opposite ends of said guideway, one of said shoulders is aligned with said first pinway at the front of said plug and the other one of said shoulders is aligned with said second pinway at the rear of said plug, said shoulders preventing said master pin from being removed from said lock without disassembly of said lock and permitting said master pin to move randomly in said guideway between said pinways;

said guiding means further includes a goove formed in the bottom of said guideway and having a depth greater than said depth for receiving said master pin, said groove is formed in said plug as a bore that extends beyond said front shoulder to said front of said plug; and said preventing means is normally received in said bore and said groove and is removable therefrom to allow insertion of said receiving means therein.

6. A lock apparatus as recited in claim 5, including key means, wherein:

said key means has bittings along a first side for positioning said master pin in said housing portion of said first pinway and aligning the bottom of said master pin with said shear interface to unlock said lock and permit rotation of said plug to align said guideway with said holes in said housing;

said receiving means is a cylindrical rod having a cut formed in one side thereof for receiving and moving said master pin in said guiding means, said rod has cam means adjacent said cut;

said removal of said preventing means from said guideway and said insertion of said receiving means in said bore and guideway before said rotation of said plug being effective to permit said master pin to enter said cut in said rod; and said rotation of said receiving means being effective when said master pin is received in said cut to cause said cam means to move said master pin from both said cut and said guiding means into said second pinway to align said bottom of said master pin with said shear interface.

7. A lock apparatus as recited in claim 6, wherein:

said guideway formed in said plug is effective to provide space to permit said master pin to move out of said first pinway, to move into said cut in said receiving means, and to move with said receiving means into alignment with said second pinway; and said shoulder means of said guideway prevents said receiving means from removing said master pin from said lock.

8. In a lock apparatus, including a lock as recited in claim 1 and means for carrying said master pin in said guiding means after removal of said preventing means from said guiding means, wherein:

said master pin has a selected bitting depth; and said carrying means is a rod having a cut in one side, said cut having a depth greater than said selected bitting depth for receiving said master pin, said rod being chamfered on both sides of said cut in the direction of said guiding means so that when said master pin is received in said cut and said carrying means carries said master pin into alignment with said second pinway said first driver pin in said first pinway from which said master pin was received rides onto one of said chamfered sides and onto the uncut surface of said rod to enable said carrying means to carry said master pin to said second pinway.

9. In a re-keyable lock apparatus, including a lock cylinder housing with a cylindrical bore extending therethrough along a longitudinal axis; a plurality of longitudinally spaced, elongated top pinways in said housing extending perpendicular to and radially outward from said cylindrical bore; a cylindrical plug positioned rotatably in and defining a shear interface with said bore; said plug having a longitudinal keyway therein for receiving a key bit and a plurality of longitudinally spaced bottom pinways extending radially inward from the peripheral surface thereof into said keyway; opposite pairs of said bottom pinways and top pinways being adapted to align with each other to form a plurality of common pinways; a top driver pin and a bottom tumbler pin slidably positioned in each of said common pinways; said plug being rotatable when the interface between said top and bottom pins is aligned with said shear interface and not being rotatable when one said pin is positioned through said shear interface; the improvement comprising:

master pin means adapted to be directly moved within said lock from one of said common pinways to a randomly selectable other one of said common pinways for providing an additional interface between said top and bottom pins therein to align with said shear interface;

key means adapted for insertion into said keyway and being bitted on one side for positioning said master pin means above said shear interface in one of said top pinways and rendering said plug rotatable from a first position to a second unlocked position, said second unlocked position being less than 180° from said first position;

means formed in said peripheral surface of said cylindrical plug and located in alignment with said top pinways when said plug is in said second position for receiving said master pin means to enable said lock to be re-keyed when said plug is in said second position;

blocking means mounted in said receiving means for normally preventing said master pin means from entering said receiving means, said blocking means being removable from said receiving means to permit said re-keying of said lock; and master pin transfer means adapted to be slidably received in said receiving means upon removal of said blocking means for receiving said master pin means from said top pinway of said first common pinway and carrying said master pin means within said lock apparatus directly into alignment with said top pinway of said randomly selectable other one of said common pinways.

10. A re-keyable lock apparatus as recited in claim 9, wherein:

means are connected to said transfer means and extend out of said receiving means for indicating that said master pin transfer means is positioned for receiving said master pin means from said top pinway of said first common pinway.

11. A re-keyable lock apparatus as recited in claim 10, wherein:

said transfer means is an elongated member having a cut in one side for receiving said master pin means, said elongated member has a cam surface extending from said cut to the other side of said elongated member; and said indicating means is adapted to rotate said elongated member when said cut is aligned with said top pinway of said randomly selectable other common pinway so that said master pin means rides onto said cam surface and into said other common pinway, said cam surface is adapted to hold said master pin means in said other common pinway until said plug is rotated from said second position toward said first position.

12. A re-keyable lock apparatus as recited in claim 9, wherein:

said master pin means includes master pins having two different bitting depths that differ by a selected bitting depth; and said transfer means is an elongated member having a cut in one side having a depth for receiving said master pin having the greater bitting depth, said member being chamfered on both sides of said cut in the direction of the elongation thereof so that when a lesser depth master pin is received in said cut and said transfer means carries said master pin into alignment with said randomly selectable other common pinway the top driver pin in said common pinway from which said lesser master pin was received rides onto one of said chamfered sides and onto the uncut surface of said elongated member to enable said transfer means to carry said lesser master pin to said randomly selectable other common pinway.

13. A re-keyable lock apparatus as recited in claim 10, wherein:

said indicating means includes an index formed by the front of said plug for visual observation outside of said lock apparatus, said indicating means further includes a series of marker lines at spaced locations on said transfer means corresponding to the spacing of said common pinways, said marker lines cooperate with said index for indicating the axial position of said transfer means to assist in receiving said master pin means from and transferring same to selected ones of said common pinways.

14. A re-keyable lock apparatus as recited in claim 9, wherein:

means are provided for retaining said plug in said bore, said means being effective to limit movement of said transfer means in said receiving means; and said transfer means includes a plurality of elongated rods, each of said rods having a cut in one side thereof for receiving said master pin means, said cuts being located at different axial locations on different ones of said rods so that said transfer means can be slid in said receiving means to align one of said cuts with said top pinways of a selected pair of said common pinways without interference with said retaining means.

15. A re-keying apparatus for randomly relocating a master pin between the top and bottom pins in a plurality of pinways of a tumbler pin lock that has a shear interface that is not penetrated by any of said pins to enable the lock to be operated, the master pin initially being between the top and bottom pins in a first of said pinways and being transferrable to a position between the top and bottom pins in a randomly selected other one of said pinways in the operation of said lock, the cylinder plug being rotatable less than 180° from a first locked position to a second unlocked position, comprising:

a first key bit adapted for insertion into a keyway of the lock and having bittings along one edge thereof adapted for aligning the interface between the master pin and the bottom pin in the first pinway with the shear interface so that said cylinder plug can be rotated to said second, unlocked position;

a groove formed in the outer surface of the cylinder plug and aligned with the pinways upon rotation of said cylinder plug into said second unlocked position, said groove being dimensioned for receiving a master pin from the pinways and permitting the master pin to slide randomly from one pinway to another pinway;

a blocking rod normally receieved in said groove for preventing said master pin from entering said groove in the normal use of the lock, said rod being removable from said groove to permit reception of the master pin in said groove for re-keying the lock;

a master pin carrier adapted to be received in said groove after removal of said blocking rod for rotary and sliding movement relative to said groove, said master pin carrier having a cut formed in one side thereof for receiving the master pin and having a cam adjacent said cut; and handle means connected to said master pin carrier and adapted to extend through said groove and out of the lock for sliding said carrier in said groove to align the master pin in said cut with said randomly selected pinway and for rotating said carrier in said groove to cause said cam to remove the master pin from said cut and transfer the master pin into said randomly selected pinway.

16. A re-keying apparatus as recited in claim 15, wherein:

a portion of said groove adjacent the front of the cylinder plug is dimensioned to prevent movement of said master pin to the front of said cylinder plug, said portion being threaded; and said blocking rod has a section that is externally threaded for cooperating with said threaded portion of said groove to removably retain said blocking rod in said groove.

17. A method of rendering a lock re-keyable with a plurality of different change keys, said re-keying being without disassembling said lock each time said lock is re-keyed for a different change key, wherein said lock is designed so that the re-keying can be performed only upon disassembly of said lock; said lock including a housing; a bore extending axially through said housing to define a shear interface; a plug received in said bore and having a keyway that extends therein from a first surface thereof; said housing and said plug having aligned holes therein forming at least first and second pinways that are located at opposite axial ends of said plug and that are divided by said shear interface; said plug being rotatably received in said bore for rotation less that 180° from a first locked position to a second unlocked position; a first pin stack including a first tumbler pin and a first driver pin received in said first pinway, and a second pin stack in said second pinway and including a second driver pin and a second tumbler pin, said method of rendering said lock re-keyable comprising the steps of:

removing said plug from said bore;

inserting at least one master pin in said first pinway between said first tumbler pin and said first driver pin;

forming a groove in the outer surface of said plug to be aligned with said pinways when said plug is at said second unlocked position, said groove being formed for a distance corresponding to the distance from said first pinway to said second pinway, the depth of said groove being sufficient to receive said master pin and the width of said groove being sufficient to permit said master pin to slide from a first forward end to a second rearward end of said groove;

forming an extension of said groove to the front of said plug, said extension being dimensioned to prevent said master pin from moving forwardly past said front end;

inserting a rod into said extension and said groove for normally preventing said master pin from being received in said groove; and replacing said plug in said bore.

18. A method of re-keying a lock that has been rendered re-keyable for use with different change keys as recited in claim 17, which comprises the further steps of:

providing a master key having bittings along one edge for unlocking said lock with said master pin above said shear interface;

providing a master pin transfer tool having a cut therein and a cam opposite to said cut;

inserting said master key into said keyway;

removing said rod from said groove and said extension;

inserting said tool in said slot;

unlocking said lock by rotating said plug, said master key and said tool to position said groove at said second unlocked position with said master pin supported by said cam;

moving said tool relative to said groove to position said cut for receiving said master pin from said first pinway;

moving said tool relative to said groove to slide said master pin between the ends of and within said groove into alignment with said second pinway;

moving said tool relative to said groove to transfer said master pin from said cut into said first pinway so that the heights of said pin stacks in said first and second pinways are changed by the height of said master pin so that said second change key must have a shallower bitting depth corresponding to said second pinway and can have a deeper bitting depth corresponding to said first pinway;

rotating said plug away from said unlocked position;

removing said tool from said groove; and reinserting said blocking rod into said groove.

19. A method of re-keying a lock for use with a plurality of different change keys and a single master key without disassembling the lock or removing any parts therefrom, said lock including a housing; a bore extending through said housing to define a shear interface; a plug received in said bore and having a keyway that extends therein from a first surface thereof, said housing and said plug having aligned holes therein forming at least first and second pinways that are spaced in the direction in which said bore extends through said housing and that are divided by said shear interface; a groove formed in said first surface of said plug at least for a distance corresponding to the distance from said first pinway to said second pinway, the depth and width of said groove being sufficient to receive said master pin, said groove being formed in said plug at a location spaced from said keyway by between about 45° and 135°, said groove being normally blocked by a removable rod; said plug being received in said bore for rotation of less than 180°; a first pin stack including a first tumbler pin, at least one master pin and a first driver pin received in said first pinway, and a second pin stack in said second pinway and including a second driver pin and a second tumbler pin; said method comprising the steps of:

inserting into said keyway a key having bittings for unlocking said lock and positioning said master pin above said shear interface;

removing said blocking rod from said groove;

inserting into said groove a master pin transfer tool, said tool having a cut therein and a cam opposite to said cut;

rotating said plug to an unlocked position with said tool in alignment with said pinways;

moving said tool relative to said groove to position said cut for receiving said master pin from said first pinway;

moving said tool relative to said groove to slide said master pin within said groove into alignment with said second pinway;

moving said tool relative to said groove to transfer said master pin from said cut into said second pinway so that the heights of said pin stacks in said first and second pinways are changed by the height of said master pin so that said second change key must have a shallower bitting depth corresponding to said first pinway and can have a deeper bitting depth corresponding to said second pinway;

rotating said plug to move said groove out of alignment with said pinways;

removing said tool from said groove;

replacing said rod in said groove; and removing said key from said keyway to enable use of said re-keyed lock with said second change key.

20. A method of rendering a lock re-keyable as recited in claim 19, wherein the setting of the lock may be reversed without removing said master pin from or adding master pins to said lock, comprising the further steps of:

removing said rod from said slot;

inserting said tool into said groove;

unlocking said lock by again inserting said key into said keyway and rotating said plug to said unlocked position;

performing said tool moving steps again with said cut initially positioned to receive said master pin from said second pinway and to transfer said master pin to and insert said master pin into said first pinway; and performing said last rotating, tool removing and rod replacing steps again to restore the stack heights to their original amounts without removing said master pin from or adding master pins to said lock.

* * * * *